US012691336B2

(12) United States Patent
Ehyaei

(10) Patent No.: US 12,691,336 B2
(45) Date of Patent: Jul. 28, 2026

(54) GOLF BALL

(71) Applicant: Taylor Made Golf Company, Inc., Carlsbad, CA (US)

(72) Inventor: Dana Ehyaei, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 17/190,864

(22) Filed: Mar. 3, 2021

(65) Prior Publication Data

US 2022/0280838 A1 Sep. 8, 2022

(51) Int. Cl.
*A63B 37/14* (2006.01)
*A63B 37/00* (2006.01)

(52) U.S. Cl.
CPC ..... *A63B 37/0006* (2013.01); *A63B 37/0018* (2013.01); *A63B 37/0019* (2013.01); *A63B 37/0021* (2013.01)

(58) Field of Classification Search
CPC ..... A63B 37/0006–00215
See application file for complete search history.

(56) References Cited

U.S. PATENT DOCUMENTS 3,264,272 A 8/1966 Watkin
4,653,758 A 3/1987 Solehim
4,744,564 A 5/1988 Yamada
4,880,241 A 11/1989 Melvin
4,936,587 A 6/1990 Lynch
4,949,976 A 8/1990 Gobush
5,072,945 A * 12/1991 Oka ..... A63B 37/0017 473/384
5,078,402 A * 1/1992 Oka ..... A63B 37/0018 473/380
5,090,705 A * 2/1992 Oka ..... A63B 37/008 473/384
5,149,100 A * 9/1992 Melvin ..... A63B 37/0018 473/383
5,156,404 A 10/1992 Oka
5,201,522 A 4/1993 Pocklington
5,253,872 A * 10/1993 Lemons ..... A63B 37/0004 473/383
5,503,397 A 4/1996 Molitor
5,527,043 A * 6/1996 Shimosaka ..... A63B 37/00065 473/383

(Continued)

FOREIGN PATENT DOCUMENTS

WO WO2009054684 A2 4/2009

*Primary Examiner* — Michael D Dennis
*Assistant Examiner* — Matthew B Stanczak
(74) *Attorney, Agent, or Firm* — Klarquist Sparkman, LLP

(57) ABSTRACT

A golf ball which, when orientated in the cross seam direction, has an equator at latitude 0°, and poles at latitude 90° and longitude 0°, an equator region Ex at latitudes 0 to 25°, a region Ei at longitudes 0 to 25°, a shoulder region Sx at latitudes from more than 25° to less than 65°, a region Si at longitudes from more than 25° to less than 65°, a pole region Px at latitudes 65° to 90°, and a region Pi at longitudes 650 to 90°. The ball dimple pattern has the following average dimple depths, hex in the region Ex, hsx in the region Sx, hpx in the region Px, hei in the region Ei, hsi in the region Si and hpi in the region Pi; and the ratios hex/hei, hsx/hsi and hpx/hpi are each greater than or equal to about 0.75 and less than or equal to about 1.20.

9 Claims, 9 Drawing Sheets

(56) References Cited

U.S. PATENT DOCUMENTS 5,588,924 A 12/1996 Sullivan
5,688,193 A 11/1997 Kasasima
5,735,757 A 4/1998 Moriyama
5,766,098 A 6/1998 Molitor
5,840,351 A 11/1998 Inoue
5,857,924 A 1/1999 Naoyuki
5,885,172 A 3/1999 Hebert
5,902,193 A 5/1999 Shimosaka
5,906,551 A 5/1999 Kasashima
5,908,359 A 6/1999 Shimosaka
6,066,055 A * 5/2000 Nishino ..... A63B 37/002 473/378
6,100,321 A 8/2000 Chen
6,206,792 B1 * 3/2001 Tavares ..... A63B 37/0004 473/378
6,329,458 B1 12/2001 Takesue
6,331,150 B1 * 12/2001 Ogg ..... A63B 37/0012 473/383
6,383,093 B1 5/2002 Kuttappa
6,428,428 B1 8/2002 Kuttappa
6,540,625 B2 4/2003 Sajima
6,558,274 B1 * 5/2003 Shimosaka ..... A63B 37/0015 473/378
6,562,906 B2 5/2003 Chen
6,569,038 B2 5/2003 Sullivan
6,582,327 B2 6/2003 Ogg
6,595,876 B2 7/2003 Kasashima
6,616,552 B2 9/2003 Takesue
6,632,150 B1 10/2003 Ogg
6,685,455 B2 2/2004 Ogg
6,685,456 B2 2/2004 Sajima
6,688,993 B2 2/2004 Sajima
6,709,349 B2 3/2004 Sullivan
6,719,646 B2 * 4/2004 Calabria ..... A63B 37/12 473/378
6,719,647 B2 4/2004 Sajima
6,793,864 B1 9/2004 Dewanjee
6,817,853 B2 11/2004 Simonds
6,863,627 B2 3/2005 Brum
6,939,252 B1 9/2005 Stanczak
7,090,593 B2 8/2006 Sullivan
7,128,666 B2 10/2006 Veilleux
7,150,618 B2 12/2006 Sajima
7,223,183 B2 5/2007 Sajima
7,320,651 B2 * 1/2008 Sajima ..... A63B 37/002 473/383
7,338,393 B2 3/2008 Veilleux
7,384,352 B2 * 6/2008 Ohama ..... A63B 37/002 473/383
7,387,504 B2 6/2008 Aoyama
7,422,529 B2 9/2008 Aoyama
7,431,670 B2 10/2008 Nardacci
7,520,824 B2 4/2009 Kasashima
7,618,333 B2 11/2009 Nardacci
7,654,919 B2 * 2/2010 Sajima ..... A63B 37/0075 473/383
7,867,109 B2 1/2011 Sullivan
7,879,968 B2 2/2011 Kim
8,047,933 B2 * 11/2011 Stefan ..... A63B 37/00065 473/384
8,137,217 B2 3/2012 Madson
8,241,150 B2 * 8/2012 Stefan ..... A63B 37/0012 473/384
8,591,355 B2 11/2013 Sullivan
8,632,423 B2 1/2014 Stefan
8,632,426 B2 1/2014 Madson
8,663,032 B2 3/2014 Fitchett
8,663,033 B2 3/2014 Fitchett
8,747,256 B2 6/2014 Fitchett
8,753,560 B2 * 6/2014 Sajima ..... A63B 37/0021 473/378
8,912,286 B2 12/2014 Kim
9,211,442 B2 12/2015 Felker
9,220,945 B2 12/2015 Madson
9,468,813 B2 * 10/2016 Tachibana ..... A63B 37/0075
9,511,524 B2 12/2016 Stefan
9,550,093 B2 * 1/2017 Mimura ..... A63B 37/0033
9,764,193 B2 9/2017 Madson
9,782,628 B2 10/2017 Madson
9,789,363 B2 10/2017 Madson
9,839,813 B2 12/2017 Squires
9,861,861 B2 * 1/2018 Kamino ..... A63B 37/0077
9,975,004 B2 * 5/2018 Sajima ..... A63B 37/002
10,046,203 B2 8/2018 Madson
10,166,440 B2 1/2019 Madson
10,300,340 B2 5/2019 Madson
10,315,078 B2 6/2019 Lin
10,420,986 B2 9/2019 Madson
10,434,372 B2 10/2019 Sajima
10,463,917 B2 11/2019 Madson
10,653,920 B2 5/2020 Madson
10,709,936 B2 7/2020 Madson
10,799,765 B2 10/2020 Madson
10,814,179 B1 * 10/2020 Madson ..... A63B 37/002
10,894,189 B2 1/2021 Madson
11,045,692 B2 * 6/2021 Madson ..... A63B 37/0012
11,173,346 B2 * 11/2021 Madson ..... A63B 37/002
11,691,052 B2 * 7/2023 Engle ..... A63B 37/002 473/383
2001/0019969 A1 * 9/2001 Binette ..... A63B 45/02 473/371
2001/0027141 A1 10/2001 Sajima
2002/0016227 A1 * 2/2002 Emerson ..... A63B 37/0006 473/378
2002/0016228 A1 * 2/2002 Emerson ..... A63B 37/0004 473/378
2002/0068649 A1 6/2002 Kennedy
2002/0147058 A1 * 10/2002 Winfield ..... A63B 37/0006 473/378
2003/0008729 A1 1/2003 Sajima
2003/0069088 A1 4/2003 Brum
2003/0134695 A1 7/2003 Kasashima
2004/0041297 A1 3/2004 Sajima
2004/0198536 A1 * 10/2004 Ohama ..... A63B 37/0074 473/378
2004/0204267 A1 * 10/2004 Sajima ..... A63B 37/0004 473/378
2004/0219996 A1 11/2004 Sullivan
2005/0006815 A1 1/2005 Simonds
2005/0113188 A1 * 5/2005 Sajima ..... A63B 37/0019 473/383
2005/0272532 A1 * 12/2005 Sajima ..... A63B 37/0019 473/378
2006/0116220 A1 * 6/2006 Ohama ..... A63B 37/0003 473/371
2006/0154748 A1 * 7/2006 Ohama ..... A63B 37/0065 473/378
2006/0154749 A1 * 7/2006 Ohama ..... A63B 37/0031 473/378
2006/0276266 A1 12/2006 Sullivan
2007/0149321 A1 * 6/2007 Sajima ..... A63B 37/0004 473/378
2007/0173350 A1 * 7/2007 Ohama ..... A63B 37/0075 473/378
2007/0173354 A1 * 7/2007 Sajima ..... A63B 37/0012 473/378
2007/0298908 A1 * 12/2007 Sajima ..... A63B 37/0004 473/384
2008/0039236 A1 * 2/2008 Isogawa ..... A63B 37/0045 473/378
2008/0064531 A1 3/2008 Nardacci
2008/0220907 A1 * 9/2008 Aoyama ..... A63B 37/002 473/383
2008/0234071 A1 9/2008 Sullivan
2008/0317892 A1 12/2008 Aoyama
2009/0088273 A1 4/2009 Nardacci
2009/0102097 A1 * 4/2009 Sajima ..... A63B 37/0019 425/116
2009/0191982 A1 * 7/2009 Kim ..... A63B 37/0083 473/378

(56) References Cited

U.S. PATENT DOCUMENTS

2009/0209367 A1* 8/2009 Stefan ..... A63B 37/0049 473/378
2009/0298618 A1* 12/2009 Kim ..... A63B 37/0007 473/378
2010/0052219 A1 3/2010 Sajima
2010/0190583 A1* 7/2010 Aoyama ..... A63B 37/0019 473/378
2010/0190584 A1* 7/2010 Sajima ..... A63B 37/0021 473/378
2010/0240473 A1 9/2010 Aoyama
2011/0034274 A1* 2/2011 Sajima ..... A63B 37/00065 473/383
2011/0111887 A1 5/2011 Sullivan
2012/0043686 A1* 2/2012 Ichikawa ..... A63B 37/0059 473/378
2012/0046127 A1 2/2012 Ichikawa
2012/0046130 A1* 2/2012 Fitchett ..... A63B 37/00622 473/378
2012/0046131 A1* 2/2012 Fitchett ..... A63B 37/0018 473/383
2012/0046132 A1* 2/2012 Fitchett ..... A63B 37/0018 473/383
2012/0108362 A1 5/2012 Felker
2013/0029784 A1* 1/2013 Ichikawa ..... A63B 37/0094 473/371
2015/0375047 A1* 12/2015 Sajima ..... A63B 37/0018 473/383
2015/0375058 A1* 12/2015 Kamino ..... A63B 37/004 473/374
2016/0059081 A1* 3/2016 Mimura ..... A63B 37/0043 473/376
2018/0161630 A1* 6/2018 Aoyama ..... A63B 37/0006
2018/0161631 A1* 6/2018 Aoyama ..... A63B 37/0006
2022/0280838 A1* 9/2022 Ehyaei ..... A63B 37/0039
2023/0148396 A1* 5/2023 Ehyaei ..... A63B 37/0021 473/378

* cited by examiner

GOLF BALL

FIELD

The present invention is a golf ball having a type of dimple and a specific arrangement of the dimples on the surface, which results in improved flight distance and flight symmetry.

BACKGROUND

Recent developments in golf ball technology have been focused not only on the development of new golf ball materials and constructions, but also the improvement in their aerodynamic properties. As far back as the 1800's golfers realized that gutta-percha golf balls with damaged or indented surfaces flew better than smooth new ones. Subsequently, golf balls with brambles (bumps rather than dents), such as the Spalding Agrippa, or with grooves such as the Spalding Silvertown were popular from the late 1800's to 1908. In 1908, William Taylor, patented a golf ball with indentations (dimples) that flew better than golf balls with brambles or grooves. For the next 60 years most balls looked exactly the same having 336 dimples of the same size distributed in an octahedron or so-called ATTI pattern over the surface. The ATTI pattern, named after its inventor Ralph Atti, was based on an octahedron, split into eight concentric straight-line rows. The only other significant innovation related to the surface of a golf ball during this sixty-year period came from Albert Penfold who invented a mesh-pattern golf ball for Dunlop. This pattern was invented in 1912 and was accepted until the 1930's.

In the 1970's, additional dimple patterns were introduced which attempted to maximize the surface area coverage of the dimples on the ball. For example, U.S. Pat. No. 4,949,976 to William Gobush discloses a golf ball with 78% dimple area coverage with up to 422 dimples. The 1990's also saw further increases in dimple surface area coverage up to and above 80%. Dimple patterns have also evolved by incorporating dimple placement in specific geometries based on sectional shapes such as pentagonal, as in U.S. Pat. No. 5,201,522, octahedral, dodecahedral and icosahedral patterns or modified versions of these such as in U.S. Pat. No. 4,880,241, which discloses a golf ball dimple pattern based on a modified icosahedron.

In addition to maximizing surface area coverage, further innovations in dimple pattern design have seen not only the number of dimples on a golf ball surface vary but also their diameters and/or depths. These have included dimple patterns with four or five to as many as eleven different dimple diameters.

More recently there have been a number of patents which have attempted to not only maximize surface coverage but also impart selected lift and drag properties for the golf ball. For instance, a drag penalty is often incurred when a single row of deep dimples are placed adjacent to the seam and U.S. Pat. No. 6,066,055 ("the '055 patent") describes how arranging dimple volume differently in (latitudinal) regions is beneficial in producing better ball symmetry, or anisotropy, in flight as compared to a single row of deep dimples near the seam.

More specifically the '055 patent teaches a method of arranging the dimples within three separate regions (where the seam line is latitude 0° and both poles are latitude 90°), an equator region defined by latitudes 0 to 17° a shoulder region defined by latitudes from more than 17° to less than 62°, and a pole region defined by latitudes 62° to 90 and when X represents total volume of dimples which belong to the parting line vicinity, Y represents total volume of dimples which belong to the pole vicinity, and Z represents total volume of dimples which belong to the shoulder portion, the ratio X/Z is set to be 0.58 to 0.72, and a ratio Y/Z is set to be 0.22 to 0.30.

The '055 patent also teaches that the dimples used should have a circular opening, spherical cross section, and the same diameter and be disposed on the whole surface of the golf ball, and that the depths of the dimples which belong to the parting line vicinity and the pole vicinity are respectively arranged to be deeper than that of the dimples which belong to the shoulder portion by 0.003 mm to 0.06 mm.

U.S. Pat. No. 8,047,933 ("the '933 patent") describes a dimple design with superior performance in carry distance for golfers whose swing profile generates moderate to low ball spin rates. This was achieved by both reducing drag on the overall ball, while increasing lift judiciously. Three separate design features were employed in combination to achieve these results.

The first was a method of arranging the dimples within three separate lateral regions (where the seam line is latitude 0° and both poles are latitude 90°), an equator region defined by latitudes 0 to 25° a shoulder region defined by latitudes from more than 25° to less than 65°, and a pole region defined by latitudes 65° to 90°. Thus, for the dimples used which all had a circular opening and spherical cross section, a pattern was used where the dimples near the pole were about 10% more shallow, and the dimples near the equator were about 5% deeper than the same design with no depth progression.

The second design feature required that the range of total dimple volume (TDV) should be greater than 370 $mm^3$ but less than 385 $mm^3$.

The third design features required that the specific dimple volume ratio, VR (defined by dimple chordal volume divided by the volume of a cylinder with the same diameter and depth as the dimple) should be set to a value of 0.55.

SUMMARY

We have now found that compared to a golf ball having primarily dimples with a circular opening and spherical cross section, further improvement in distance may be achieved by replacing the spherical dimples with dimples having the same circular opening but a cross sectional profile having a dual radius. The radii of curvature are selected such that the dimple depth can be reduced while maintaining dimple volume.

We have also found that improvement in in seam versus cross seam distance symmetry for such improved distance golf balls having dual radius dimples may be obtained by controlling the average dimple depth (h) in the equator, shoulder and pole regions of the golf ball when the golf ball is oriented in the cross seam direction (hex, hsx, hpx respectively) as well as the average dimple depths in the regions from the pole axis to 25° longitude, the region of longitude greater than 25° to less than 65° and the region from longitude 65° to 90° (hei, hsi and hpi respectively).

The distance symmetry at increased distance is also maintained by requiring that the ratios hex/hei, hsx/hsi and hpx/hpi all approach unity and that these ratios remain close to unity as the golf ball is initially placed in the cross seam orientation and rotated about its polar axis from 0 to 360°.

DETAILED DESCRIPTION

Figure 1A:
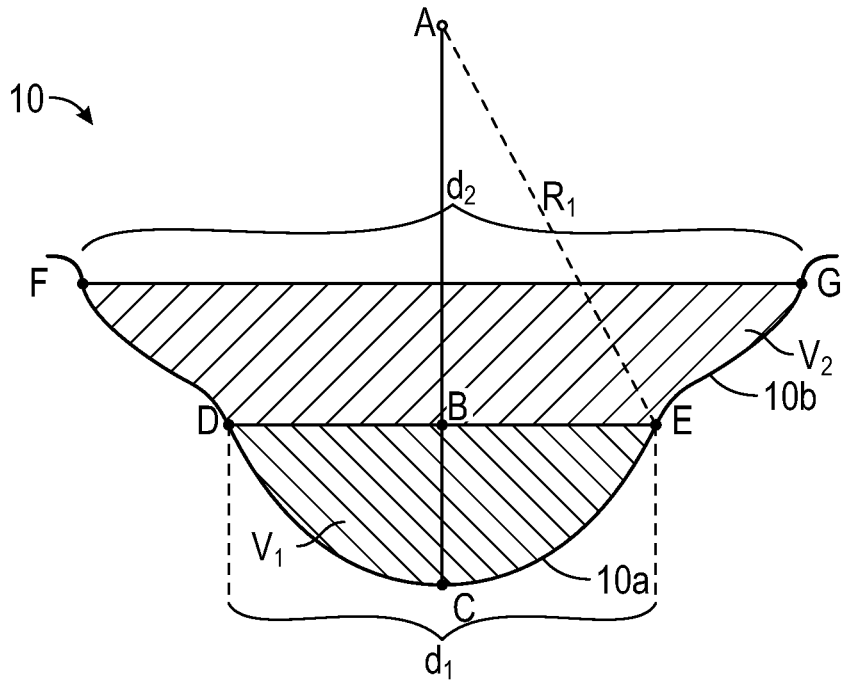
FIGS. 1A and 1B are views for explaining the specifics of a dual radius dimple.

Having briefly described the present invention, the above and further objects, features and advantages thereof will be recognized by those skilled in the pertinent art from the following detailed description of the invention when taken in conjunction with the accompanying drawings.

Any numerical values recited herein include all values from the lower value to the upper value. All possible combinations of numerical values between the lowest value and the highest value enumerated herein are expressly included in this application.

The following definitions are provided to aid the reader and are not intended to provide term definitions that would be narrower than would be understood by a person of ordinary skill in the art of golf ball composition and manufacture.

Definitions

The term "bimodal polymer" refers to a polymer comprising two main fractions and more specifically to the form of the polymer's molecular weight distribution curve, i.e., the appearance of the graph of the polymer weight fraction as a function of its molecular weight. When the molecular weight distribution curves from these fractions are superimposed onto the molecular weight distribution curve for the total resulting polymer product, that curve will show two maxima or at least be distinctly broadened in comparison with the curves for the individual fractions. Such a polymer product is called bimodal. The chemical compositions of the two fractions may be different.

As used herein, the term "core" is intended to mean the elastic center of a golf ball, which may have a unitary construction. Alternatively, the core itself may have a layered construction, e.g., having a spherical "center" and additional "core layers," with such layers being made of the same material as the core center.

The term "cover" is meant to include any layer of a golf ball that surrounds the core. Thus, a golf ball cover may include both the outermost layer and also any intermediate layers, which are disposed between the golf ball core and outer cover layer. "Cover" may be used interchangeably with the term "cover layer."

As used herein the term "equator' and "poles" of a golf ball are defined for a spherical golf ball as follows. In this application most drawings and descriptions consider the two-dimensional golf ball sphere. For definiteness we will take the unit sphere of unit radius in three-dimensional space with center the origin, O. This is the set of satisfying the equation:

$$x^2+y^2+z^2=1.$$

where the xy-plane, is called the equatorial plane, which is the horizontal plane and the z-axis as vertical. Any plane passing through the origin cuts the sphere in a circle called a great circle, so the center of a great circle and the center of the sphere coincide. The equatorial plane meets the sphere of the golf ball in a great circle called the equator.

The line through the center of the golf ball sphere perpendicular to the plane of equator meets the outer surface of the golf ball sphere in two antipodal points called the poles of the golf ball. The poles of the equator are the north pole N=(0,0,1) and the south pole S=(0, 0, −1).

The term "intermediate layer" may be used interchangeably with "mantle layer," "inner cover layer" or "inner cover" and is intended to mean any layer(s) in a golf ball disposed between the core and the outer cover layer.

In the case of a ball with a core, two intermediate layers, and an outer cover layer the term "inner intermediate layer" may be used interchangeably herein with the terms "inner mantle" or "inner mantle layer" and is intended to mean the intermediate layer of the ball positioned nearest to the core, and the term "outer intermediate layer" may be used interchangeably herein with the terms "outer mantle" or "outer mantle layer" and is intended to mean the intermediate layer of the ball which is disposed nearest to the outer cover layer.

In the case of a ball with a core, three intermediate layers and an outer cover layer the term "inner intermediate layer" may be used interchangeably herein with the terms "inner mantle" or "inner mantle layer" and is intended to mean the intermediate layer of the ball positioned nearest to the core, the term "outer intermediate layer" may be used interchangeably herein with the terms "outer mantle" or "outer mantle layer" and is intended to mean the intermediate layer of the ball which is disposed nearest to the outer cover layer. The term "center intermediate layer" may be used interchangeably herein with the terms "center mantle" or "center mantle layer" and is intended to mean the intermediate layer of the ball positioned between the inner and outer intermediate layers The term "outer cover layer" is intended to mean the outermost cover layer of the golf ball on which, for example, the dimple pattern, paint and any writing, symbol, etc. is placed. If, in addition to the core, a golf ball comprises two or more cover layers, only the outermost layer is designated the outer cover layer. The remaining layers may be designated intermediate layers. The term outer cover layer is interchangeable with the term "outer cover."

If no intermediate layer is introduced between the core and outer cover layer, a so called "two-piece ball" results, if one additional intermediate layer is introduced between the core and outer cover layer, a so called "three-piece ball"

results, if two additional intermediate layers are introduced between the unitary core and outer cover layer, a so called "four-piece ball" results, and if three intermediate layers are introduced between the core and outer cover layer, a so called "five-piece ball" results, and so on.

The term "(meth)acrylate" is intended to mean an ester of methacrylic acid and/or acrylic acid.

The term "(meth)acrylic acid copolymers" is intended to mean copolymers of methacrylic acid and/or acrylic acid.

The term "polyurea" as used herein refers to materials prepared by reaction of a diisocyanate with a polyamine.

The term "polyurethane" as used herein refers to materials prepared by reaction of a diisocyanate with a polyol.

The term "reduced equivalent depth dimple" as used herein refers to dimples which have a circular opening and which have a cross sectional profile which results in their exhibiting lower depth than the corresponding spherical single radius dimple of the same diameter and volume. Non-limiting examples of such dimple profiles include dual radius, multiple radius and cylindrical dimple profiles The term "seam" as used herein refers to a line formed on the ball by the coming together of the hemispherical mold halves during the molding process used to make a golf ball. In addition to the term "seam" this line is also referred to as the "parting line" of the golf ball as these terms may be used interchangeably herein. (Given that the mold halves are hemispherical the golf ball seam is often coincident with the golf ball equator).

In reference to the golf ball seam, the term "cross seam" as used herein refers to an orientation of the ball such that when placed on the teeing ground the seam is aligned in the horizontal direction and when launched, the ball would spin about the axis described by a line that would pass through the seam (equator) of the ball and that would lie in horizontal plane and be perpendicular to the direction of flight Again, in reference to the golf ball seam, the term "in seam" as used herein refers to an orientation of the ball such that when placed on the teeing ground the seam is aligned in the vertical direction and when launched, the ball would spin about an axis described by a line that would pass through the poles of the ball and that would lie in horizontal plane and be perpendicular to the direction of flight.

A "thermoplastic" is generally defined as a material that is capable of softening or melting when heated and of hardening again when cooled. Thermoplastic polymer chains often are not cross-linked or are lightly crosslinked using a chain extender, but the term "thermoplastic" as used herein may refer to materials that initially act as thermoplastics, such as during an initial extrusion process or injection molding process, but which also may be cross-linked, such as during a compression molding step to form a final structure.

A "thermoset" is generally defined as a material that crosslinks or cures via interaction with as crosslinking or curing agent. The crosslinking may be brought about by energy in the form of heat (generally above 200 degrees Celsius), through a chemical reaction (by reaction with a curing agent), or by irradiation. The resulting composition remains rigid when set and does not soften with heating. Thermosets have this property because the long-chain polymer molecules cross-link with each other to give a rigid structure. A thermoset material cannot be melted and re-molded after it is cured thus thermosets do not lend themselves to recycling unlike thermoplastics, which can be melted and re-molded.

The term "unimodal polymer" refers to a polymer comprising one main fraction and more specifically to the form of the polymer's molecular weight distribution curve, i.e., the molecular weight distribution curve for the total polymer product shows only a single maximum.

The above term descriptions are provided solely to aid the reader and should not be construed to have a scope less than that understood by a person of ordinary skill in the art or as limiting the scope of the appended claims.

The singular terms "a," "an," and "the" include plural referents unless context clearly indicates otherwise. The word "comprises" indicates "includes." It is further to be understood that all molecular weight or molecular mass values given for compounds are approximate and are provided for description. The materials, methods, and examples are illustrative only and not intended to be limiting. Unless otherwise indicated, description of components in chemical nomenclature refers to the components at the time of addition to any combination specified in the description, but does not necessarily preclude chemical interactions among the components of a mixture once mixed.

Any numerical values recited herein include all values from the lower value to the upper value in increments of one unit provided that there is a separation of at least 2 units between any lower value and any higher value. As an example, if it is stated that the amount of a component or a value of a process variable is from 1 to 90, preferably from 20 to 80, more preferably from 30 to 70, it is intended that values such as 15 to 85, 22 to 68, 43 to 51, 30 to 32 etc., are expressly enumerated in this specification. For values, which have less than one unit difference, one unit is considered to be 0.1, 0.01, 0.001, or 0.0001 as appropriate. Thus, all possible combinations of numerical values between the lowest value and the highest value enumerated herein are said to be expressly stated in this application.

The present invention can be used to form golf balls of any desired size. "The Rules of Golf" by the USGA dictate that the size of a competition golf ball must be at least 1.680 inches in diameter; however, golf balls of any size can be used for leisure golf play. The preferred diameter of the golf balls is from about 1.670 inches to about 1.800 inches. Oversize golf balls with diameters above about 1.760 inches to as big as 2.75 inches also are within the scope of the invention.

Typically, manipulation of dimple volume in a spherical single radius dimple is achieved by varying dimple diameter and/or depth. Dimple diameter and depth is measured generally according to the teachings of U.S. Pat. No. 4,936,587 (the '587 patent), which is included herein by reference thereto. In a regular spherical dimple, a single radius, R, describes the shape of the bottom of the dimple to its open surface. In other words, this radius governs the shape of the dimple toward the bottom of the dimple as well as its depth and volume.

The present invention seeks to increase the distance of a golf ball by shallowing the dimples to reduce the drag. Shallow dimples generate high air flow circulation and high lift, but too much lift also can result in loss of distance if the golf ball balloons in flight. This is mediated or offset by selecting the volume of the dimple, so it is sufficient to create the required degree of turbulence to avoid the ball flight ballooning. In a typical spherical profile dimple the depth and volume are directly coupled so that shallowing the dimple also reduces its volume and so reaches a limit into how much they can be shallowed without inducing ballooning.

Figure 8:
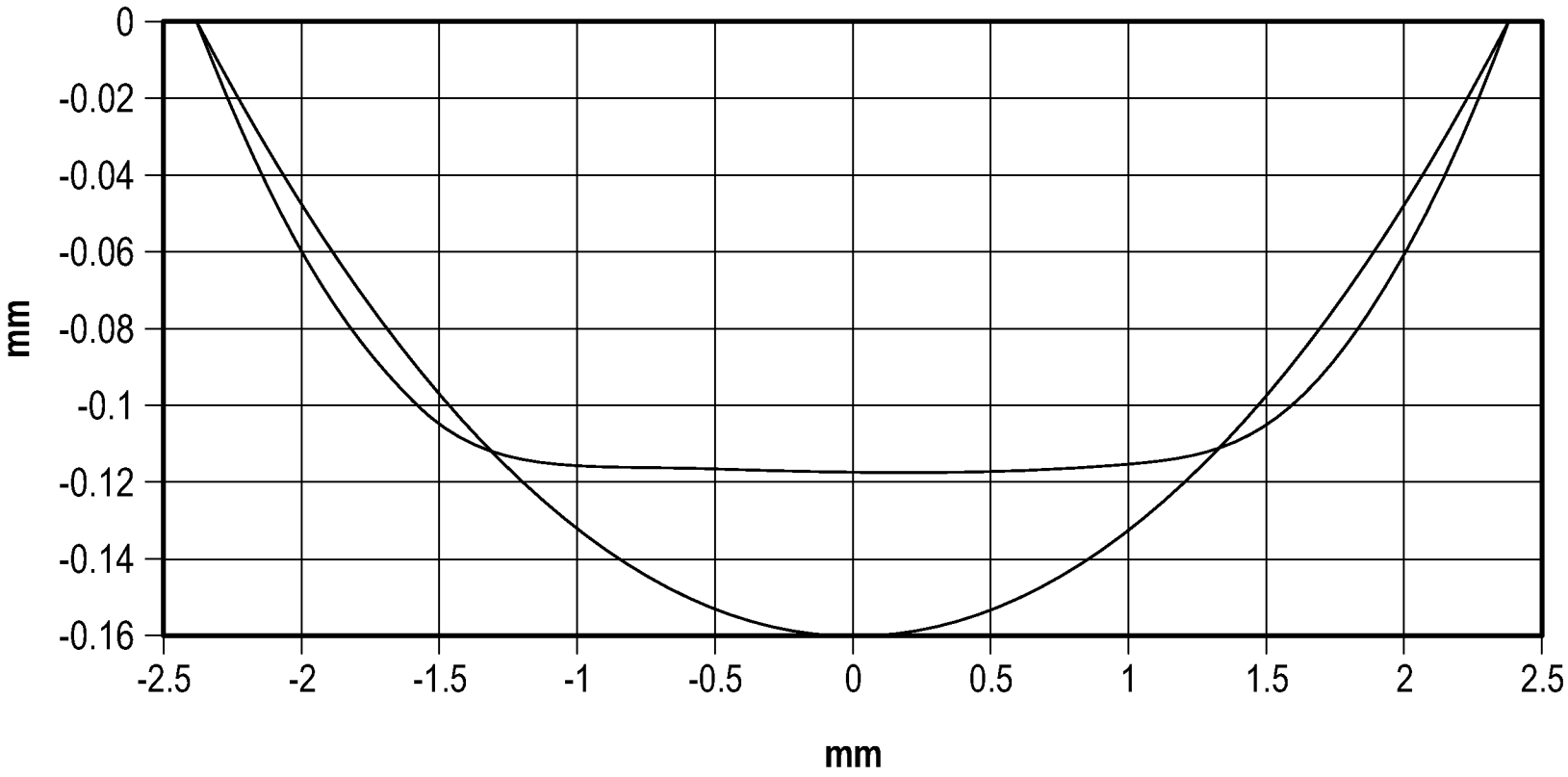
FIG. 8 is a diagrammatic representation below (not drawn to scale) of features of a dual radius dimple.

In a typical dual radius dimple, on the other hand, two radii are used to describe the shape of the dimple. The major radius ($R_1$) describes the bottom of the dimple, and a minor radius ($R_2$) describes the shape of the dimple about its circumference. As shown by FIG. 8, a feature of the dual radius dimple having a major radius $R_1$ is that by judicious selection of the minor radius $R_2$, it is possible to produce a shallower dimple with no change in total dimple volume or dimple diameter as compared with the corresponding spherical single radius dimple having the same major radius $R_1$.

This "decoupling" of dimple depth from dimple volume not only allows a shallowing of dimples for a given volume in dual radius dimples but also allows for the same effect in dimples with multiple radii as well as dimples having non curved surfaces. Such examples include but are not limited to multiple radius dimples, cylindrical dimples and, to facilitate the dimple molding process, it is also preferable if such dimple profiles such as cylindrical are modified such that they are not planar at their base but rather have a spherical bottom cap which facilitates both their molding and subsequent removal from the mold.

The cross-sectional profile or dimple shape comprising the dimple patterns of the golf balls of the present invention thus include not only dual radius dimples but also all dimples of spherical opening which have a cross sectional profile which allow dimples having the same opening diameter and dimple volume to exhibit lower depth than the corresponding spherical single radius dimple of the same diameter and volume. These dimples collectively are called "reduced equivalent depth" dimples.

More specifically in terms of a reduced equivalent depth dual radius dimple, FIG. 1A shows a cross section of a dual radius dimple, 10 used in the present invention. The dual radius dimple 10 has a surface opening portion of a complete circular shape and is formed into concave shapes which extend from their opening edges and include bottom wall portions 10*a* and peripheral wall portion 10*b*.

In the dual radius dimple 10, the curvature ($R_1$) of the bottom wall portion 10*a* and the curvature ($R_2$) of the peripheral wall portion 10*b*, which extends from the upper end of the bottom wall portion 10*b* to the opening edge are made different from each other.

The dimple diameter ($d_2$) represents the diameter at the open end of the dual radius dimple, or the distance between both contact points F and G of a common tangent connected between both left hand and right hand opening edges of each of the dimple 10, i.e., the distance F-G in FIG. 1A. In the double radius dimple 10, the diameter ($d_1$) is represented by the distance between both left hand and right hand transition points D and E located at the boundary of the curvature $R_1$ of the bottom wall portion 10*a* and the curvature $R_2$ of the peripheral wall portion 10*b*, i.e., the distance D-E in FIG. 1A.

For the dual radius dimples used in the present invention the relations between the diameters ($d_1$) and ($d_2$) are set to a relative ratio, a, according to the following equation, $$\alpha=d_1/d_2$$

where $1>\alpha>0$; and more preferably $0.95\geq\alpha\geq0.35$; and even more preferably $a=0.70\geq\alpha\geq0.40$ The two cross-hatched regions in FIG. 1A represent in cross section the total dimple volume, which represents the two different regions of the dimple. The lower dimple region is at bordered by lower wall portion 10*a* below the line between the transition points D and E, which corresponds to a volume V1. The upper region of the dimples is that which corresponds to the region above the plane corresponding to the line between the transition points D and E and below the plane corresponding to the line between both contact points F and G of a common tangent connected between both left hand and right hand opening edges of each of the dimple 10. This upper dimple region has a volume $V_2$. The total volume of the dimple $V_t$ thus corresponds to the sum $V_1+V_2$.

Again, referring to FIG. 1B, the dual radius dimple 10, the curvature of the spherical bottom wall portion 10*a* up to transition points D and E has a radius of curvature $R_1$ and a diameter $d_1$, a depth $h_1$ and a volume $V_1$. The volume of this spherical bottom portion of the dimple $V_1$ is calculated by the expression for a spherical end cap of a sphere such that $$V_1=\pi h_1^2/3(3R_1-h_1)$$

Referring again to FIG. 1B, the upper region of the dimple as bordered by the upper wall portion, 10*b* is shown in cross section as the area between the line drawn between points F and G at opening edges of the dimple and the line drawn between the points D and E, which are the transition points between the wall portions 10*a* and 10*b*. The radius of curvature of this peripheral wall portion 10*b* has a value $R_2$, a diameter $d_2$ and a depth $h_2$.

Figure 1B:
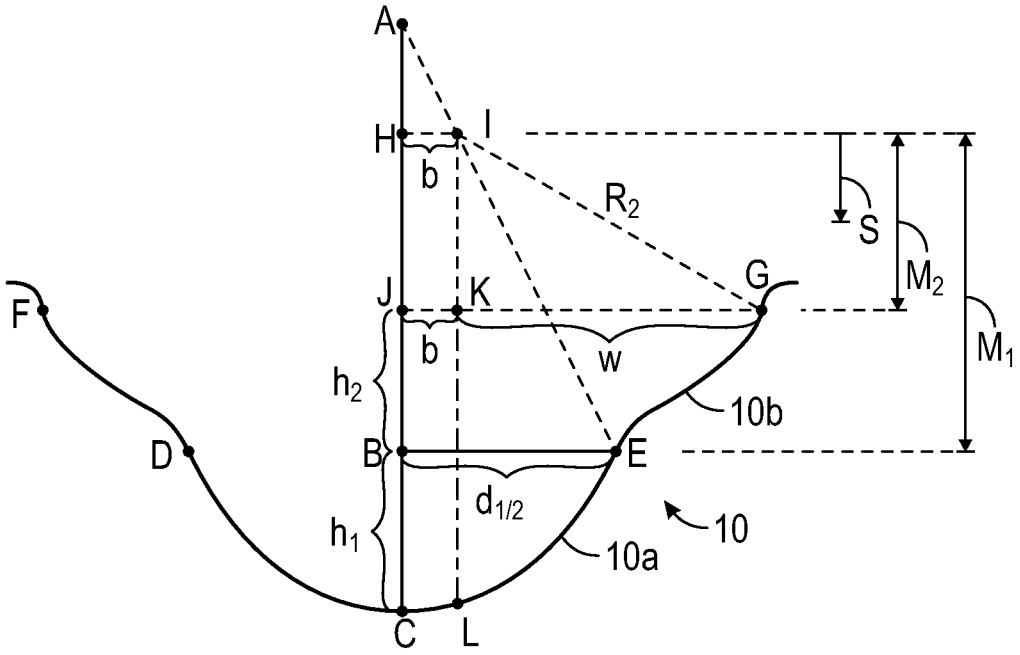

The perpendicular I-L in FIG. 1B, represents a perpendicular line drawn downwardly in the direction S from point I (the intersection of the line A-E and the boundary of the curvature of $R_2$ from point G) to point L, its intersection with the spherical bottom wall portion 10*a*.

The volume $V_2$ of the upper dimple region may be expressed by integrating the area function between the limits $m_1$ and $m_2$ as follows:

$$\int_{m1}^{m2} \pi(b+\omega(S))^2 dS$$

where:

$$b=((R_1-R_2)/R_1)(d_1/2);\text{ and}$$

$$\omega(S)=\sqrt{R2^2-S^2}$$

and solving for $m_1$ and $m_2$:

$$m_1^2 = R_2^2 - (d_1/2 - b)^2$$

and $$m_2^2 = R_2^2 - (d_2/2 - b)^2$$

Referring now to FIG. 1B, the line A-C represents a perpendicular drawn from the deepest portion of the dimple, point C to the boundary of the curvature of $R_1$ at point A. Along this perpendicular, the depth ($h_1$) of the lower region of the dimple as bordered by the bottom wall portion, 10*a*, corresponds to the length of the line B-C where B represents the intersection of the line D-E with the perpendicular. Similarly, the depth ($h_2$) of the upper region of the dimple as bordered by the upper wall portion, 10*b*, corresponds to the length of the line B-J where J represents the intersection of the line F-G with the perpendicular. The total depth of the dimple, ht, thus corresponds to the sum $h_1+h_2$.

$$h_t=h_1+h_2$$

We have now found that the substitution of dual radius dimples for single radius dimples of the same dimple diameter results in a ball with increased distance. While not wishing to be bound by any theory, it is thought that the decoupling of dimple depth from dimple volume in dual radius dimples allows the use of shallower dimples to reduce drag while maintaining sufficient volume to avoid the penalty of loss of distance by increased lift, (which causes "ballooning in golf ball flight). We have also found that although the use of reduced equivalent depth dimples such as dual radius dimples allows for shallowing of the dimples while maintaining their volume, there is a limit to how shallow such dimples can go.

Figure 2:
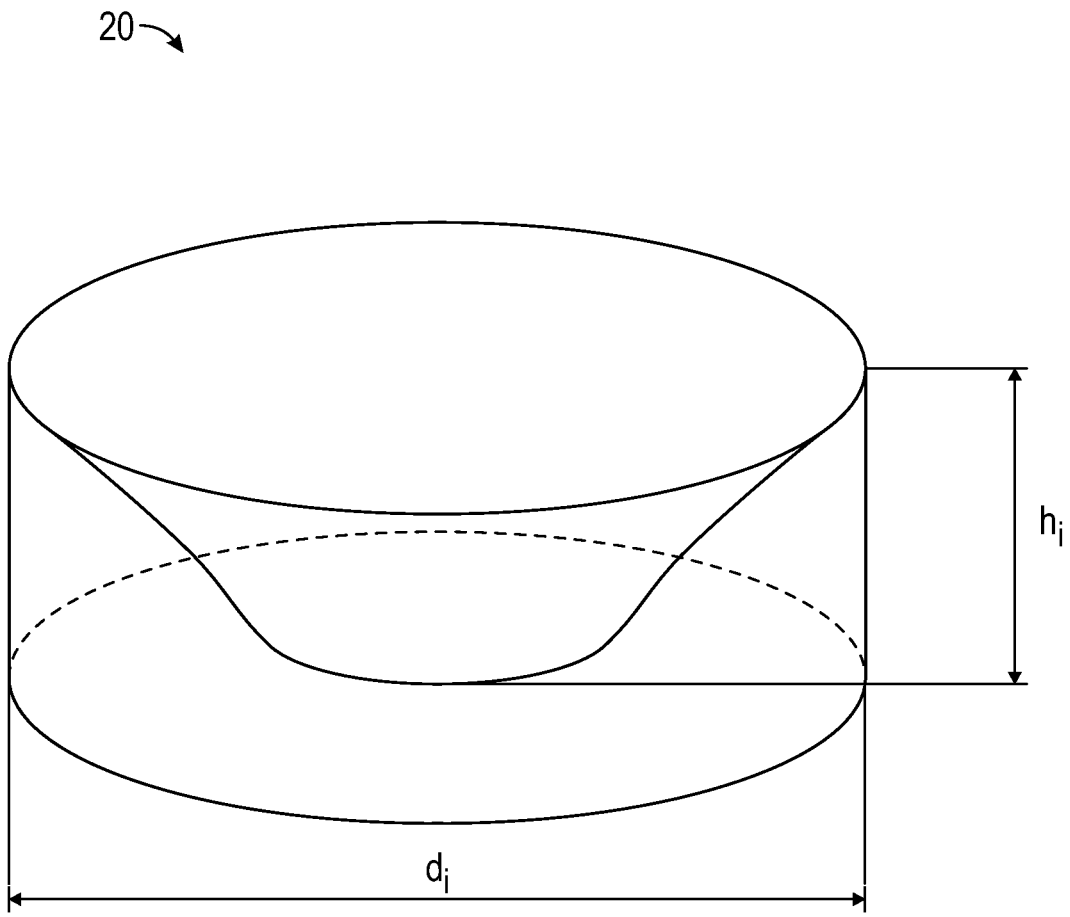
FIG. 2 is a schematic view showing how to calculate the Volume Ratio, Vr, of a dimple

FIG. 2 shows how to calculate the dimple volume ratio, Vr, of a dimple 20, which is defined as the amount by which the total volume of a dual radius dimple approaches that of a cylinder having the same opening diameter and depth and is calculated as follows:

$$Vr_i = V_i/\pi h_i di^2/4$$

Where Vi is the total volume of dimple i, di is the outer diameter of dimple i and $h_i$ is the total depth of dimple i.

Thus, the shallower the dimples go as compared to their volume, the higher the volume ratio becomes.

The average dimple volume ratio (AvVr) is given by $$AvVr = \sum_{i=1}^{N} Vri/N$$

Thus, the shallowness of the dimples may be tailored from a manufacturing point of view by requiring all dimples to have the same Vr in which case the individual dimple volume ratio and the average dimple volume ratio become the same. Alternatively, if one seeks to shallow certain dimples by one amount and others by a different amount then the average volume ratio, AvVr is more descriptive.

It should also be noted that, at a certain shallowness, the dimples lose their aerodynamic effect. Thus, the dimple volume ratio Vr of each of the dimples used in the present invention or the average volume ratio AvVr of the dual radius dimples used in the present invention should be of from about 0.5 to less than about 1, preferably of from about 0.525. to about 0.75, even more preferably of from about 0.55 to about 0.70.

The total number of dimples (Ni) employed on the golf balls of the present invention comprise of from about 250 to about 500, preferably of from 275 to about 475, and even more preferably of from about 300 to about 450 reduced equivalent depth dimples. Preferably the reduced equivalent depth dimples comprise dual radius dimples.

Other parameters which must be considered when selecting dimples and the dimple patterns used in the golf balls of the present invention include both the total number of dimples (Ni) employed as well as their total dimple volume ("TDV") and the total surface area coverage (COV) of the dimples placed on the surface of the golf balls of the present invention.

The total volume of the dimples (TDV) employed on the golf balls of the present invention is calculated using the following formula, $$TDV = \sum_{i=1}^{n} V_i$$

where TDV is of from about 380 to 425 $mm^3$, preferably of from about 385 to 415 $mm^3$, more preferably of from about 380 to 405 $mm^3$.

The total percentage surface area coverage (COV) of the dimples placed on the surface of the golf balls of the present invention is calculated using the following formula, $$COV = 100 * \sum_{i=1}^{n} \pi(d_i^2/4)/A_o$$

Where di is the outer diameter of the dimple and $A_o$ is the surface area of a golf ball surface formed by the continuation of the land area surface if the dimples where removed (where the land area is the surface of the ball lying between the dimples). For the golf balls of the present invention $A_o$ has a value of 5720 $mm^2$ and COV is greater than about 65%, more preferably greater than about 70%, and even more preferably greater than about 75%.

We have also surprisingly found that further improvements in flight performance of golf balls with dual radius dimples, including improved inseam/cross seam dispersion of the increased distance, may be achieved by selective placement of the dual radius dimples in selected regions of the golf ball.

Figure 3A:
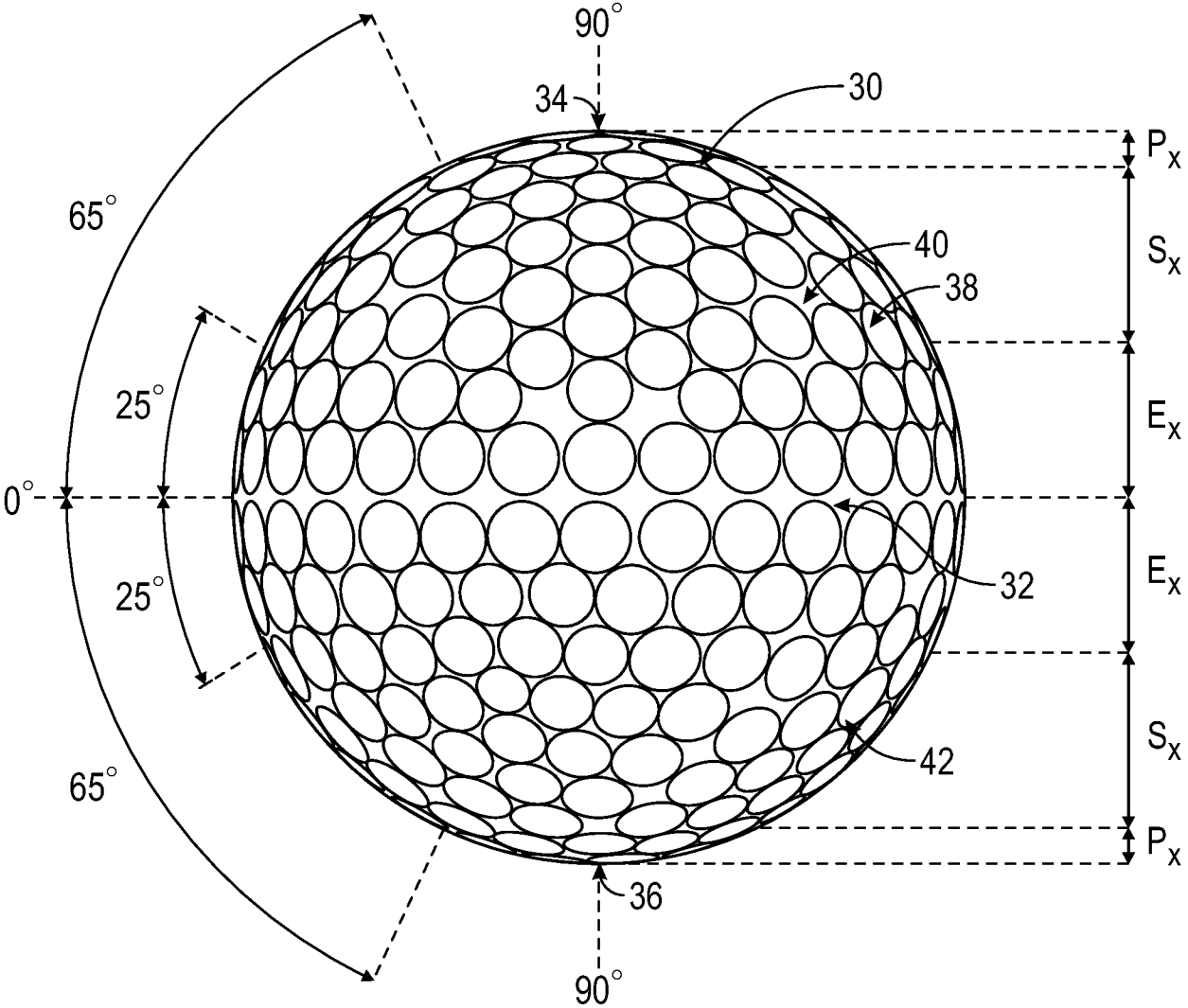
FIGS. 3A and 3B shows a golf ball, 30, in which the ball is oriented in the cross seam direction and has an equator or seam or parting line 32, two poles 34 and 36, and dimples 38.
Figure 3B:
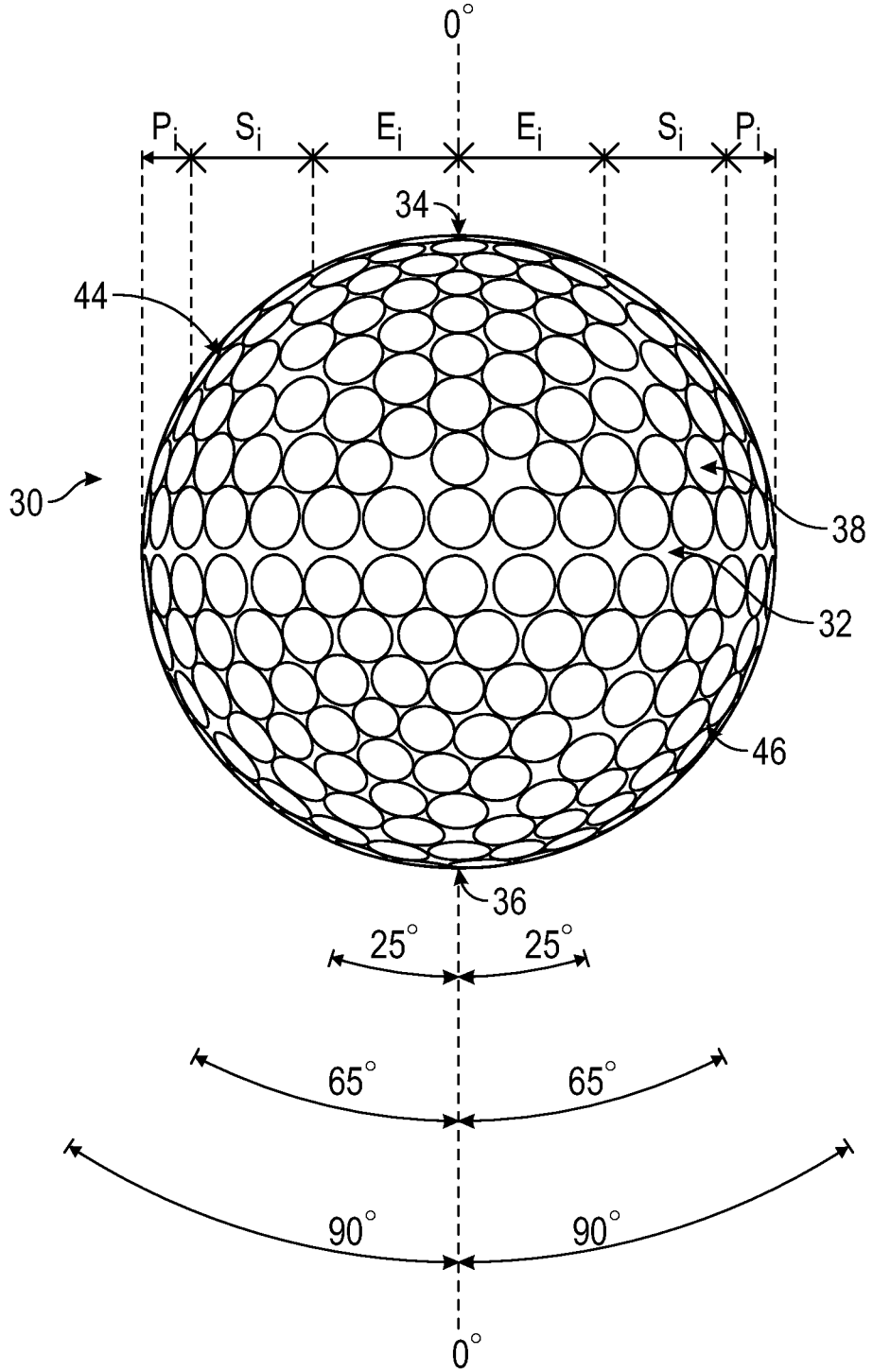

FIGS. 3A and 3B show a golf ball, 30, of the present invention in which the ball is oriented in the cross seam direction and has an equator or seam or parting line 32, two poles 34 and 36, and dimples 38. Referring to FIG. 3A the golf ball equator or parting line 32 divides the golf ball 30 into a first hemisphere 40 and a second hemisphere 42. A first pole 34 is located ninety degrees along a longitudinal arc from the equator 32 in the first hemisphere 40. A second pole 36 is located ninety degrees along a longitudinal arc from the equator 32 in the second hemisphere 42.

Referring to FIG. 3A, an equatorial zone Ex is then defined as the equator area on the ball surface occurring between latitudes 0 to 25° in hemisphere 40 as well as the second hemisphere 42. Similarly, the shoulder zone Sx is defined as the shoulder area on the ball surface occurring between latitudes greater than 25° to less than 65° in each hemisphere, finally zone Px is defined as the pole areas on the ball defined by latitudes from 65° to 90° in each hemisphere.

Referring to FIG. 3B, the pole axis 34-36 represents 0° longitude and divides the ball longitudinally into two hemispheres 44 and 46. The region from the pole axis 34-36 to 25° longitude in hemisphere 44 as well as the second hemisphere 46 is defined as region Ei, the region of longitude greater than 25° to less than 65° in each hemisphere 44 and 46 is defined as region Si, and the region from longitude 65° to 90° in each hemisphere 44 and 46 is defined as region Pi.

The average total volumes of the dimples in in the regions Ex, Sx, Px, Ei, Si, and Pi, ($\nabla_{ex}$ $\nabla_{sx}$ $\nabla_{px}$ $\nabla_{ei}$ $\nabla_{si}$ and $\nabla_{pi}$ respectively) is obtained by summing the dimple volumes (V) of all the dimples in a given region and dividing it by the number of dimples (N) in that region. Note that a dimple is said to be in a given region when the center of its circular opening resides within the latitudinal or longitudinal limits of that region as defined above. Thus, for example the average dimple volume in the Ex region, $\nabla_{ex}$, is determined by the following summation:

$$\overline{V}ex = \sum_{N=1}^{x} \frac{V}{Nex}$$

For the golf balls of the present invention, the ratios ∇ex/∇ei, ∇sx/∇si and ∇px/∇pi are each all greater than or equal to 0.60 and less than or equal to 1.25, preferably each all greater than or equal to 0.65 and less than or equal to 1.20, and even more preferably each all greater than or equal to 0.7 and less than or equal to 1.15.

We have also surprisingly found that improvement in inseam versus cross seam distance symmetry for such improved distance golf balls having dual or multiple radius dimples may be obtained by controlling the ratios of average dimple depth (h) in the regions Ex, Sx, Px, Ei, Si, and Pi (hex, hsx, hpx, hei, hsi and hpi respectively).

The average dimple depth in a given region is obtained by summing the dimple depths (h) of all dimples in a given region and dividing it by the number of dimples (N) in that region. Note that a dimple is said to be in a given region when the center of its circular opening resides within the latitudinal or longitudinal limits of that region as defined above. Thus, for example the average dimple depth in the Ex region, hex, is determined by the following summation:

$$hex = \sum_{N=1}^{x} \frac{h}{Nex}$$

For the golf balls of the present invention, the depth of the dimples of the golf balls of the present invention are of from about 0.060 to about 0.200 mm, preferably of from about 0.065 to about 0.180 mm, more preferably of from about 0.070 to about 0.160 mm.

For the golf balls of the present invention, the average depth of the dimples in each region, namely hex, hsx, hpx and hei, hsi and hpi are each of from about 0.060 to about 0.200 mm, preferably of from about 0.065 to about 0.180 mm, more preferably of from about 0.070 to about 0.160 mm.

For the golf balls of the present invention, the ratios hex/hei, hsx/hsi and hpx/hpi are each all greater than or equal to 0.75 and less than or equal to 1.20, preferably each all greater than or equal to 0.78 and less than or equal to 1.15, and even more preferably each all greater than or equal to 0.80 and less than or equal to 1.10.

Figure 6:
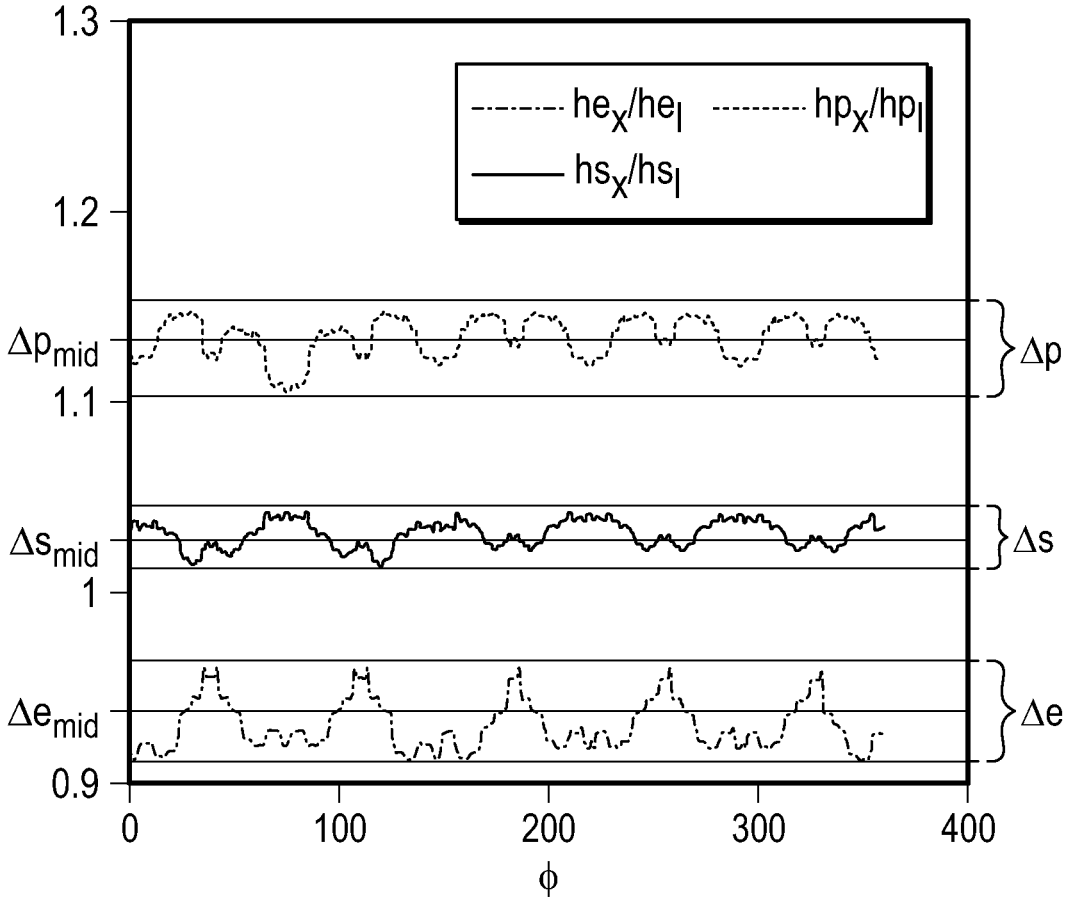
FIG. 6 is a graph showing the observed change in the ratios, hex/hei, hsx/hsi and hpx/hpi, when the golf ball is initially placed in the cross seam orientation and rotated about its polar axis by a value of Ø as it rotates 0 to 360°.

In addition to prescribing the above described ratios of hex/hei, hsx/hsi and hpx/hpi as measured when the position of the ball is fixed in either the cross seam or in seam direction, we have also surprisingly found that the observed improvement in in seam versus cross seam distance symmetry for such improved distance golf balls having dual radius dimples is also the result of maintaining the described ratios of hex/hei, hsx/hsi and hpx/hpi such that the difference between their minimum and maximum values Δe, Δs and Δp respectively, as measured when the ball is initially placed in the cross seam orientation and rotated from 0 to 360 degrees about its polar axis, are maintained within a certain range. FIG. 6 shows the observed change in each of these ratios Δe, Δs and Δp, as the golf ball is rotated by a value of 0 about its polar axis when the ball is initially placed in the cross seam orientation and rotated from 0 to 3600 about its polar axis. FIG. 6 also shows the midline between the minima and maxima of each of these ratios, which is denoted as $\Delta e_{mid}$, $\Delta s_{mid}$ and $\Delta p_{mid}$ respectively.

This magnitude of the variation in the ratios of hex/hei, hsx/hsi and hpx/hpi measured when the ball is rotated from 0 to 360 degrees about either its polar or equatorial axis, is then expressed as a percentage of the midline value i.e. % Ae, % As and % Δp respectively, which are calculated as follows, $$\% \Delta e = (\Delta e / \Delta e_{mid}) \times 100;$$

$$\% \Delta s = (\Delta s / \Delta s_{mid}) \times 100; \text{ and}$$

$$\% \Delta p = (\Delta p / \Delta p_{mid}) \times 100$$

For the golf balls of the present invention, % Δe, % Δs and % Δp are each preferably greater than 0 but less than about 7%, more preferably each greater than about 0.5% but less than about 6.5%, and even more preferably each greater than about 1% but less than about 6%.

Golf balls are typically produced by pressing together two hemispherical mold halves that form a dimple pattern in a suitable material, such as a synthetic resin or other material, contained in the mold. In conventional approaches, the resulting golf ball may have a line formed on the ball called a parting line or seam which is the line formed by the coming together of the hemispherical mold halves during the molding process. In some cases, the dimples are separated slightly to make room for the parting line, which results in a perceptible parting line between the halves of the ball, which is coincident with the golf ball equator. In other cases, the mold halves are manufactured such the mating surfaces interlock to varying degrees when coming together such that the parting line or seam is more closely associated with the curvature of the dimples in close proximity the parting line and thus the parting line may in some cases straddle the equator of the golf ball at various points. This renders the parting line or seam less noticeable and thus are often referred to as "seamless" dimple patterns as compared the more convention patterns with a more noticeable seam. Such attempts to configure the parting line to minimize visibility and its effect on the dimple pattern are described in U.S. Pat. No. 9,511,524 to R. Stefan and having an issue date of Dec. 6, 2016, the entire contents of which are incorporated by reference herein.

The golf balls of the present invention are not limited to the type of parting line configuration selected and include both the conventional type of seam as well any of the so-called seamless dimple parting lines.

However, the generation of the dimple pattern as occurs during the molding process of the outer cover layer of the golf balls of the present invention provides another constraint on how shallow a dimple may be used. The golf ball seam is formed when the two halves of a golf ball mold come together in the molding process at the mold parting line, some seepage or flash of the molten polymer used for the outer cover in the vicinity of the golf ball parting occurs. On cooling and removal of the golf ball from the mold this polymer seepage or flash tends to stay with the ball and must be removed by an abrasive buffing procedure. Great care is required during the buffing process to avoid damaging the dimple edges.

Figure 7:
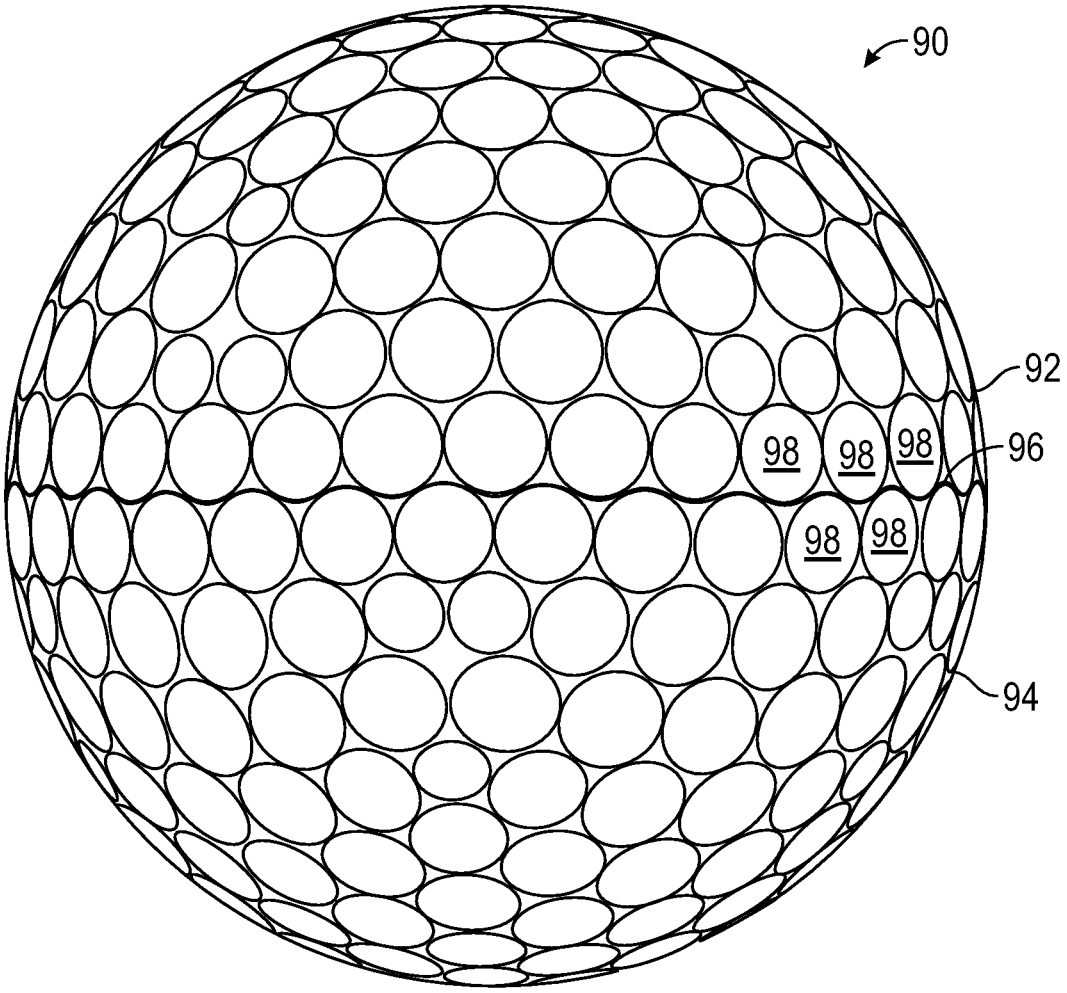
FIG. 7 is a perspective view of a golf ball which shows the position of the seam of a so-called seamless golf ball as may be used in the golf balls of the present invention.

Buffing problems for the so called "seamless" balls are more acute as the ball has a wavy parting line such as shown for golf ball 90 in FIG. 7, The golf ball is formed from a first hemispherical portion 92 and a second hemispherical portion 94 that are joined together at the mold parting line 96. This wavy parting line 96 allows for the interdigitation of dimples across the equator. A more severe buffing problem for such "seamless" dimple patterns arises because of the dimples 98 which are located so close to the parting line 96. Attempts to alleviate this problem may include the use of additional stock in the parting line vicinity and or chamfering the parting line to minimize the contact area.

For the golf balls with the dimple pattern of the present invention the problem is further alleviated by constraining the total depth ($h_t$) of each dimple in the Ex region and closest to the parting line of the golf ball to be greater than about 0145 mm, preferably greater than 0.150 mm, even more preferably greater than about 0.155 mm.

Given the ubiquity of synthetic polymers and their wide range of properties it is not surprising that a large number of polymers along with their attendant stabilizing additive and filler packages are generally considered useful for making the components of the golf balls of the present invention including their core, intermediate layer(s) and outer cover layer. These include, without limitation the materials and attendant manufacturing methods described in U.S. Pat. No. 8,047,933, column 7 line 14 to column 22, line 6, the contents of which are herein incorporated by reference.

More specific examples of particular polymeric materials useful for making golf ball cores, optional intermediate layer(s) and outer covers, again without limitation, are provided below.

A most preferred polymeric material for the outer cover layer of the golf ball of the present invention is a polyurea or polyurethane, prepared by combining a diisocyanate with either a polyamine or polyol respectively, and one or more chain extenders (in the case of a thermoplastic polyurea or polyurethane) or curing agents (in the case of a thermoset polyurea or polyurethane) The final composition may advantageously be employed as an intermediate layer in a golf ball and even more advantageously as an outer cover layer.

The diisocynate and polyol or polyamine components may be previously combined to form a prepolymer prior to reaction with the chain extender or curing agent. Any such prepolymer combination is suitable for use in the present invention. Commercially available prepolymers include LFH580, LFH120, LFH710, LFH1570, LF930A, LF950A, LF601D, LF751D, LFG963A, LFG640D.

In the case of a thermoset polyurethane or polyurea, most preferred prepolymers are the polytetramethylene ether glycol terminated toluene diisocyanate prepolymers including those available from Uniroyal Chemical Company of Middlebury, Conn., under the trade name ADIPRENE® LF930A, LF950A, LF601D, and LF751D.

Preferably the curative may comprise a slow-reacting diamine or a fast-reacting diamine or any and all mixtures thereof. Such diamines include dimethylthio-2,4-toluenediamine sold under the trade name Ethacure® 300 and diethyl-2,4-toluenediamine sold under the trade name Ethacure® 100 both by Albermarle Corporation, Other curatives or additional additives may be added to control the cure rate of the thermoset mixture including diols polyols and polymeric diols and polyols. On such diol is butane 1,4-diol, Because the polyureas or polyurethanes used to make the covers of such golf balls generally contain an aromatic component, e.g., aromatic diisocyanate, polyol, or polyamine, they are susceptible to discoloration upon exposure to light, particularly ultraviolet (UV) light. To slow down the discoloration, light and UV stabilizers, e.g., TINUVIN® 770, 765, 571 and 328, are added to these aromatic polymeric materials. In addition, non-aromatic components may be used to minimize this discoloration, one example of which is described in U.S. Pat. No. 7,879,968, filed on May 31, 2007, the entire contents of which are hereby incorporated by reference.

The formulations and methods of making the thermoset polyurethane and polyurea used to form the outer cover layers of the golf balls of the present invention are more fully disclosed in U.S. Pat. No. 6,793,864 issuing on Sep. 21, 2004, the entire contents of which are incorporated herein by reference.

The outer cover and/or one or intermediate layers of the golf ball may also comprise one or more ionomer resins. One family of such resins was developed in the mid-1960's, by E.I. DuPont de Nemours and Co., and sold under the trademark SURLYN®. Preparation of such ionomers is well known, for example see U.S. Pat. No. 3,264,272. Generally speaking, most commercial ionomers are unimodal and consist of a polymer of a mono-olefin, e.g., an alkene, with an unsaturated mono- or dicarboxylic acids having 3 to 12 carbon atoms. An additional monomer in the form of a mono- or dicarboxylic acid ester may also be incorporated in the formulation as a so-called "softening comonomer." The incorporated carboxylic acid groups are then neutralized by a basic metal ion salt, to form the ionomer. The metal cations of the basic metal ion salt used for neutralization include $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$, with the $Li^+$, $Na^+$, $Ca^{2+}$, $Zn^{2+}$, and $Mg^{2+}$ being preferred. The basic metal ion salts include those of for example formic acid, acetic acid, nitric acid, and carbonic acid, hydrogen carbonate salts, oxides, hydroxides, and alkoxides.

The first commercially available ionomer resins contained up to 16 weight percent acrylic or methacrylic acid, although it was also well known at that time that, as a general rule, the hardness of these cover materials could be increased with increasing acid content. Hence, in Research Disclosure 29703, published in January 1989, DuPont disclosed ionomers based on ethylene/acrylic acid or ethylene/methacrylic acid containing acid contents of greater than 15 weight percent. In this same disclosure, DuPont also taught that such so called "high acid ionomers" had significantly improved stiffness and hardness and thus could be advantageously used in golf ball construction, when used either singly or in a blend with other ionomers.

More recently, high acid ionomers can be ionomer resins with acrylic or methacrylic acid units present from 16 wt. % to about 35 wt. % in the polymer. Generally, such a high acid ionomer will have a flexural modulus from about 50,000 psi to about 125,000 psi.

Ionomer resins further comprising a softening comonomer, present from about 10 wt. % to about 50 wt. % in the polymer, have a flexural modulus from about 2,000 psi to about 10,000 psi, and are sometimes referred to as "soft" or "very low modulus" ionomers. Typical softening comonomers include n-butyl acrylate, iso-butyl acrylate, n-butyl methacrylate, methyl acrylate and methyl methacrylate.

Today, there are a wide variety of commercially available ionomer resins based both on copolymers of ethylene and (meth)acrylic acid or terpolymers of ethylene and (meth) acrylic acid and (meth)acrylate, all of which many of which are be used as a golf ball component. The properties of these ionomer resins can vary widely due to variations in acid content, softening comonomer content, the degree of neutralization, and the type of metal ion used in the neutralization. The full range commercially available typically includes ionomers of polymers of general formula, E/X/Y polymer, wherein E is ethylene, X is a $C_3$ to $C_8$ $\alpha,\beta$-ethylenically unsaturated carboxylic acid, such as acrylic or methacrylic acid, and is present in an amount from about 2 to about 30 weight % of the E/X/Y copolymer, and Y is a softening comonomer selected from the group consisting of alkyl acrylate and alkyl methacrylate, such as methyl acrylate or methyl methacrylate, and wherein the alkyl groups have from 1-8 carbon atoms, Y is in the range of 0 to about 50 weight % of the E/X/Y copolymer, and wherein the acid groups present in said ionomeric polymer are partially neutralized with a metal selected from the group consisting of lithium, sodium, potassium, magnesium, calcium, barium, lead, tin, zinc or aluminum, and combinations thereof.

The ionomer may also be a so-called bimodal ionomer as described in U.S. Pat. No. 6,562,906 (the entire contents of which are herein incorporated by reference). These ionomers are bimodal as they are prepared from blends comprising polymers of different molecular weights. Specifically they include bimodal polymer blend compositions comprising: a) a high molecular weight component having molecular weight of about 80,000 to about 500,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said high molecular weight component being partially neutralized with metal ions selected from the group consisting of lithium, sodium, zinc, calcium, magnesium, and a mixture of any these; and b) a low molecular weight component having a molecular weight of about from about 2,000 to about 30,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said low molecular weight component being partially neutralized with metal ions selected from the group consisting of lithium, sodium, potassium, magnesium, calcium, barium, lead, tin, zinc or aluminum, and a mixture of any these.

In addition to the unimodal and bimodal ionomers, also included are the so-called "modified ionomers" examples of which are described in U.S. Pat. Nos. 6,100,321, 6,329,458 and 6,616,552, the entire contents of all of which are herein incorporated by reference.

The modified unimodal ionomers may be prepared by mixing: a) an ionomeric polymer comprising ethylene, from 5 to 25 weight percent (meth)acrylic acid, and from 0 to 40 weight percent of a (meth)acrylate monomer, said ionomeric polymer neutralized with metal ions selected from the group consisting of lithium, sodium, potassium, magnesium, calcium, barium, lead, tin, zinc or aluminum, and any and all mixtures thereof; and b) from about 5 to about 40 weight percent (based on the total weight of said modified ionomeric polymer) of one or more fatty acids or metal salts of said fatty acid, the metal selected from the group consisting of lithium, sodium, potassium, magnesium, calcium, barium, lead, tin, zinc or aluminum, and any and all mixtures thereof; and the fatty acid preferably being stearic acid.

The modified bimodal ionomers, which are ionomers derived from the earlier described bimodal ethylene/carboxylic acid polymers (as described in U.S. Pat. No. 6,562,906, the entire contents of which are herein incorporated by reference), are prepared by mixing; a) a high molecular weight component having molecular weight of about 80,000 to about 500,000 and comprising one or more ethylene/α,β-ethylenically unsaturated $C_{3-8}$ carboxylic acid copolymers and/or one or more ethylene, alkyl (meth)acrylate, (meth) acrylic acid terpolymers; said high molecular weight component being partially neutralized with metal ions selected from the group consisting of lithium, sodium, potassium, magnesium, calcium, barium, lead, tin, zinc or aluminum, and any and all mixtures thereof; and b) a low molecular weight component having a molecular weight of about from about 2,000 to about 30,000 and comprising one or more ethylene/α,β-ethylenically unsaturated $C_{3-8}$ carboxylic acid copolymers and/or one or more ethylene, alkyl(meth)acrylate, (meth)acrylic acid terpolymers; said low molecular weight component being partially neutralized with metal ions selected from the group consisting of lithium, sodium, potassium, magnesium, calcium, barium, lead, tin, zinc or aluminum, and any and all mixtures thereof; and c) from about 5 to about 40 weight percent (based on the total weight of said modified ionomeric polymer) of one or more fatty acids or metal salts of said fatty acid, the metal selected from the group consisting of lithium, sodium, potassium, magnesium, calcium, barium, lead, tin, zinc or aluminum, and any and all mixtures thereof; and the fatty acid preferably being stearic acid.

More specifically, the fatty or waxy acid salts utilized in the various modified ionomers are composed of a chain of alkyl groups containing from about 4 to 75 carbon atoms (usually even numbered) and characterized by a —COOH terminal group. The generic formula for all fatty and waxy acids above acetic acid is $CH_3(CH_2)_xCOOH$, wherein the carbon atom count includes the carboxyl group (i.e. x=2-73). The fatty or waxy acids utilized to produce the fatty or waxy acid salts modifiers may be saturated or unsaturated, and they may be present in solid, semi-solid or liquid form.

Examples of suitable saturated fatty acids, i.e., fatty acids in which the carbon atoms of the alkyl chain are connected by single bonds, include but are not limited to stearic acid ($CH_3(CH_2)_{16}COOH$), palmitic acid ($CH_3(CH_2)_{14}COOH$), pelargonic acid ($CH_3(CH_2)_7COOH$) and lauric acid ($CH_3(CH_2)_{10}COOH$). Examples of suitable unsaturated fatty acids, i.e., a fatty acid in which there are one or more double bonds between the carbon atoms in the alkyl chain, include but are not limited to oleic acid ($CH_3(CH2)_7CH{:}CH(CH_2)_7COOH$).

The source of the metal ions used to produce the metal salts of the fatty or waxy acid salts used in the various modified ionomers are generally various metal salts which provide the metal ions capable of neutralizing, to various extents, the carboxylic acid groups of the fatty acids. These include the sulfate, carbonate, acetate and hydroxylate salts of zinc, barium, calcium and magnesium.

Since the fatty acid salts modifiers comprise various combinations of fatty acids neutralized with a large number of different metal ions, several different types of fatty acid salts may be utilized in the invention, including metal stearates, laureates, oleates, and palmitates, with calcium, zinc, sodium, lithium, potassium and magnesium stearate being preferred, and calcium and sodium stearate being most preferred.

The fatty or waxy acid or metal salt of said fatty or waxy acid is present in the modified ionomeric polymers in an amount of from about 5 to about 40, preferably from about 7 to about 35, more preferably from about 8 to about 20 weight percent (based on the total weight of said modified ionomeric polymer).

As a result of the addition of the one or more metal salts of a fatty or waxy acid, from about 40 to 100, preferably from about 50 to 100, more preferably from about 70 to 100 percent of the acidic groups in the final modified ionomeric polymer composition are neutralized by a metal ion. Suitable modified ionomer polymers contemplated for use with the present invention include, but are not limited to, Dupont® HPF 1000, Dupont® HPF 1035, Dupont® HPF AD 1072, Dupont® HPF 2000, Dupont® HPC AD 1043, and Dupont® HPC AD 1022, all commercially available from E.I. du Pont de Nemours and Company.

A preferred ionomer composition may be prepared by blending one or more of the unimodal ionomers, bimodal ionomers, or modified unimodal or bimodal ionomeric polymers as described herein, and further blended with a zinc neutralized ionomer of a polymer of general formula E/X/Y where E is ethylene, X is a softening comonomer such as acrylate or methacrylate and is present in an amount of from 0 to about 50, preferably 0 to about 25, most preferably 0, and Y is acrylic or methacrylic acid and is present in an amount from about 5 wt. % to about 25, preferably from about 10 to about 25, and most preferably about 10 to about 20 wt % of the total composition.

Golf ball materials within the scope of the present invention also can include, in suitable amounts, one or more additional ingredients generally employed in plastics formulation or the preparation of golf ball compositions. Conventional additives such as plasticizers, pigments, antioxidants, U.V. absorbers, optical brighteners, or any other additives may generally employed. Agents provided to achieve specific functions, such as additives and stabilizers, can be present. Exemplary suitable ingredients include colorants, antioxidants, colorants, dispersants, mold releasing agents, processing aids, fillers, and any and all combinations thereof. Although not required, UV stabilizers, or photo stabilizers such as substituted hydroxyphenyl benzotriazoles may be utilized in the present invention to enhance the UV stability of the final compositions. An example of a commercially available UV stabilizer is the stabilizer sold by Ciba Geigy Corporation under the tradename TINUVIN®.

Typically, the various golf ball intermediate layer and/or cover formulations compositions are made by mixing together the various components and other additives with or without melting them. Dry blending equipment, such as a tumble mixer, V-blender, ribbon blender, or two-roll mill, can be used to mix the compositions. The golf ball compositions can also be mixed using a mill, internal mixer such as a Banbury or Farrel continuous mixer, extruder or combinations of these, with or without application of thermal energy to produce melting.

The cores of the golf balls of the present invention may include the traditional rubber components used in golf ball applications including, both natural and synthetic rubbers, such as cis-1,4-polybutadiene, trans-1,4-polybutadiene, 1,2-polybutadiene, cis-polyisoprene, trans-polyisoprene, polyalkenamers, polychloroprene, polybutylene, styrene-butadiene rubber, styrene-butadiene-styrene block copolymer and partially and fully hydrogenated equivalents, styrene-isoprene-styrene block copolymer and partially and fully hydrogenated equivalents, nitrile rubber, silicone rubber, and polyurethane, as well as mixtures of these. Polybutadiene rubbers, especially 1,4-polybutadiene rubbers containing at least 40 mol %, and more preferably 80 to 100 mol % of cis-1,4 bonds, are preferred because of their high rebound resilience, moldability, and high strength after vulcanization. The polybutadiene component may be synthesized by using rare earth-based catalysts, nickel-based catalysts, or cobalt-based catalysts, conventionally used in this field. Polybutadiene obtained by using lanthanum rare earth-based catalysts usually employ a combination of a lanthanum rare earth (atomic number of 57 to 71)-compound, but particularly preferred is a neodymium compound.

When synthetic rubbers such as the aforementioned polybutadienes and/or its blends are used in the golf balls of the present invention they may contain further materials typically often used in rubber formulations including cross-linking agents, co-crosslinking agents, peptizers and accelerators.

Suitable cross-linking agents for use in the golf balls of the present invention include peroxides, sulfur compounds, or other known chemical cross-linking agents, as well as mixtures of these. Non-limiting examples of suitable cross-linking agents include primary, secondary, or tertiary aliphatic or aromatic organic peroxides such as Trigonox® 145-45B, marketed by Akrochem Corp. of Akron, Ohio; 1,1-bis(t-butylperoxy)-3,3,5 tri-methylcyclohexane, such as Varox® 231-XL, marketed by R.T. Vanderbilt Co., Inc. of Norwalk, Conn.; and di-(2,4-dichlorobenzoyl)peroxide.

Besides the use of chemical cross-linking agents, exposure of the composition to radiation also can serve as a cross-linking agent. Radiation can be applied to the unsaturated polymer mixture by any known method, including using microwave or gamma radiation, or an electron beam device. Additives may also be used to improve radiation curing of the diene polymer.

The rubber and cross-linking agent may be blended with a co-cross-linking agent, which may be a metal salt of an unsaturated carboxylic acid. Examples of these include zinc and magnesium salts of unsaturated fatty acids having 3 to 8 carbon atoms, such as acrylic acid, methacrylic acid, maleic acid, and fumaric acid, palmitic acid with the zinc salts of acrylic and methacrylic acid being most preferred. The core compositions used in the present invention may also incorporate one or more of the so-called "peptizers".

The peptizer preferably comprises an organic sulfur compound and/or its metal or non-metal salt. Examples of such organic sulfur compounds include thiophenols, such as pentachlorothiophenol, 4-butyl-o-thiocresol, 4 t-butyl-p-thiocresol, and 2-benzamidothiophenol; thiocarboxylic acids, such as thiobenzoic acid; 4,4' dithio dimorpholine; and, sulfides, such as dixylyl disulfide, dibenzoyl disulfide; dibenzothiazyl disulfide; di(pentachlorophenyl)disulfide; dibenzamido diphenyldisulfide (DBDD), and alkylated phenol sulfides, such as VULTAC® marketed by Atofina Chemicals, Inc. of Philadelphia, Pa. Preferred organic sulfur compounds include pentachlorothiophenol, and dibenzamido diphenyldisulfide.

Examples of the metal salt of an organic sulfur compound include sodium, potassium, lithium, magnesium calcium, barium, cesium and zinc salts of the above-mentioned thiophenols and thiocarboxylic acids, with the zinc salt of pentachlorothiophenol being most preferred.

Examples of the non-metal salt of an organic sulfur compound include ammonium salts of the above-mentioned thiophenols and thiocarboxylic acids wherein the ammonium cation has the general formula $[NR_1R_2R_3R_4]^+$ where $R_1$ $R_2$ $R_3$ and $R_4$ are selected from the group consisting of hydrogen, a $C_1$-$C_{20}$ aliphatic, cycloaliphatic or aromatic moiety, and any and all combinations thereof, with the most preferred being the $NH_4^+$-salt of pentachlorothiophenol.

Additional peptizers include aromatic or conjugated peptizers comprising one or more heteroatoms, such as nitrogen, oxygen and/or sulfur. More typically, such peptizers are heteroaryl or heterocyclic compounds having at least one heteroatom, and potentially plural heteroatoms, where the plural heteroatoms may be the same or different. Such peptizers include peptizers such as an indole peptizer, a quinoline peptizer, an isoquinoline peptizer, a pyridine peptizer, purine peptizer, a pyrimidine peptizer, a diazine peptizer, a pyrazine peptizer, a triazine peptizer, a carbazole peptizer, or combinations of such peptizers. A most preferred such peptizer is a tetrachloro-pyridinethiol and most preferably 2,3,5,6-tetrachloro-4-pyridinethiol.

Such peptizers are more fully disclosed in U.S. Pat. No. 8,912,286 issuing on Dec. 16, 2014, the entire contents of which are herein incorporated by reference.

The core component polymer(s), crosslinking agent(s), filler(s) and the like can be mixed together with or without melting them. In one method of manufacture the cross-linking agents and other components can be added to the unsaturated polymer as part of a concentrate using dry blending, roll milling, or melt mixing. The various core components can be mixed together with the cross-linking agents, or each additive can be added in an appropriate sequence to the milled unsaturated polymer. The resulting mixture can be subjected to, for example, a compression or injection molding process, to obtain solid spheres for the core. The polymer mixture is subjected to a molding cycle in which heat, and pressure are applied while the mixture is confined within a mold. The cavity shape depends on the portion of the golf ball being formed. The compression and heat liberate free radicals by decomposing one or more peroxides, which initiate cross-linking. The temperature and duration of the molding cycle are selected based upon the type of peroxide and peptizer selected. The molding cycle may have a single step of molding the mixture at a single temperature for fixed time duration.

After core formation, the golf ball cover and any mantle layers are typically positioned over the core using one of three methods: casting, injection molding, or compression molding.

Injection molding generally involves using a mold having one or more sets of two hemispherical mold sections that mate to form a spherical cavity during the molding process. The pairs of mold sections are configured to define a spherical cavity in their interior when mated. When used to mold an outer cover layer for a golf ball, the mold sections can be configured so that the inner surfaces that mate to form the spherical cavity include protrusions configured to form dimples on the outer surface of the molded cover layer. When used to mold an intermediate layer(s) onto an existing structure, such as a ball core, the mold includes a number of support pins disposed throughout the mold sections. The support pins are configured to be retractable, moving into and out of the cavity perpendicular to the spherical cavity surface. The support pins maintain the position of the core while the molten material flows through the gates into the cavity between the core and the mold sections. The mold itself may be a cold mold or a heated mold Compression molding of a ball outer cover or intermediate layer(s) may also utilize the initial step of making half shells by injection molding the layer material into an injection mold. The half shells then are positioned in a compression mold around a ball core, whereupon heat and pressure are used to mold the half shells into a complete layer over the core, with or without a chemical reaction such as crosslinking Compression molding also can be used as a curing step after injection molding. In such a process, an outer layer of thermally curable material is injection molded around a core in a cold mold. After the material solidifies, the ball is removed and placed into a mold, in which heat, and pressure are applied to the ball to induce curing in the outer layer.

Covers may also be formed around the cores using compression molding. Cover materials for compression molding may also be extruded or blended resins or castable resins.

In the case of outer cover layers made from a thermoset polyurethane or polyurea composition for golf balls of the present invention a most preferred method is that of casting. Casting (also called "cast-molding") is performed in a ball cavity formed by bringing together two mold halves that define respective hemispherical cavities. Casting is especially suitable when forming the outer cover layer of a thermoset material, including the thermoset polyurethane or polyurea formulations used in the golf balls of the present invention. In the casting process, a precise amount of liquid thermoset resin is introduced into a first mold cavity of a given pair of mold half shells and allowed to partially cure ("gel"). The core or preformed core with any intermediate layers is placed in the hemispherical cavity of one mold half and supported by the partially cured resin.

Once the castable composition is at least partially cured (e.g., to a point where the core will not substantially move), additional castable composition is introduced into a second mold cavity of each pair, and the mold is closed. As the mold halves are brought together, the resin flows around the core and forms the cover. The closed mold is then subjected to heat and pressure to cure the composition, thereby forming the outer layer about the core. The mold is then cooled for removal of the ball from the mold body. The mold cavities include a negative of the dimple pattern of the present invention to impart the dimples onto the outer cover layer. A more complete description of cast molding a thermoset polyurethane or polyurea outer cover on a preformed golf ball core having one or more intermediate layers is disclosed in U.S. Pat. No. 5,885,172 issuing on Mar. 23, 1999, the entire contents of which are incorporated by reference herein.

Figure 4:
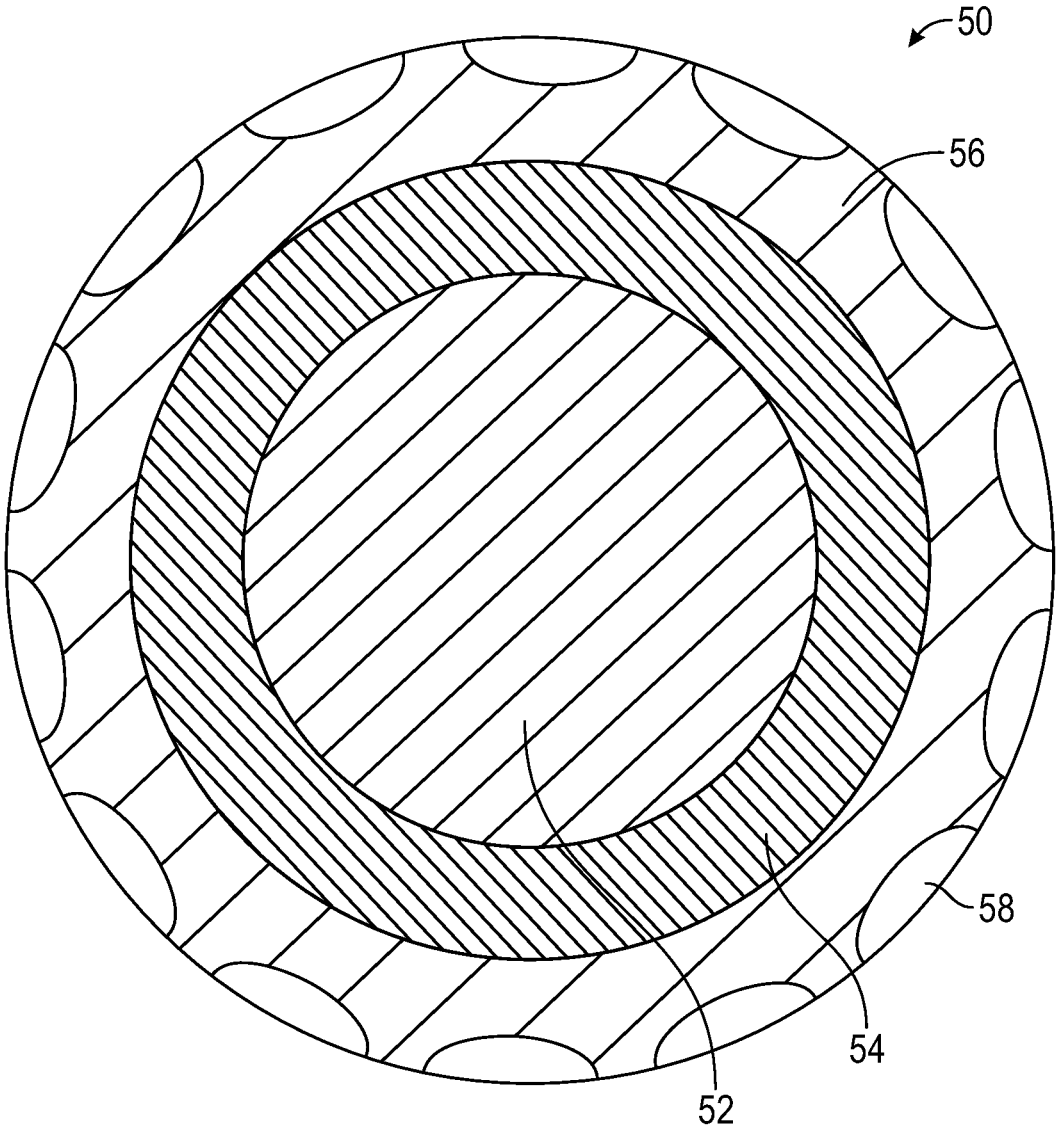
FIG. 4 illustrates a transverse cross section of a 3 piece golf ball 50 comprising a core 52, an intermediate layer 54 and an outer cover layer 56. Golf ball 50 also typically includes plural dimples 58 formed in the outer cover layer 56 (dimples 58 are not to scale, and FIG. 4 does not illustrate the presently disclosed dimple pattern).

The golf balls of the present invention may comprise from 0 to at least 5 intermediate layer(s), preferably from 0 to 3 intermediate layer(s), more preferably from 1 to 3 intermediate layer(s), and most preferably 1 to 2 intermediate layer(s). FIG. 4 and illustrate a three piece and five piece golf ball construction respectively, More generally, the intermediate layers of the golf balls of the present invention have a thickness of about 0.01 to about 0.50, preferably from about 0.02 to about 0.30 or more preferably from about 0.03 to about 0.20 or most preferably from about 0.02 to about 0.10 in.

More generally, the intermediate layers of the golf balls of the present invention also have a hardness greater than about 25 and less than about 85, preferably greater than about 30 and less than about 80, more preferably greater than about 35 and less than about 75, and most preferably greater than about 35 and less than about 70 Shore D units as measured on the ball.

More generally, the intermediate layers of the golf balls of the present invention also have a flexural modulus from about 5 to about 500, preferably from about 15 to about 400, more preferably from about 20 to about 300, still more preferably from about 25 to about 200, and most preferably from about 30 to about 150 kpsi.

More generally, the outer cover layer of the golf balls of the present invention have a thickness of about 0.010 to about 0.08, preferably from about 0.015 to about 0.06, and more preferably from about 0.020 to about 0.040 in.

More generally, the outer cover layer of the golf balls of the present invention also has a hardness from about 40 to about 70, preferably from about 45 to about 70 or about 50 to about 70, more preferably from 47 to about 68 or about 45 to about 70, and most preferably from about 50 to about 65 Shore D as measured on the ball.

More generally, the COR of the golf balls of the present invention is greater than about 0.760, preferably greater than about 0.780, more preferably greater than 0.790, most preferably greater than 0.795, and especially greater than 0.800 at 125 ft/sec inbound velocity.

More generally, the COR of the golf balls of the present invention is also greater than about 0.760, preferably greater than about 0.780, more preferably greater than 0.790, most preferably greater than 0.795, and especially greater than 0.800 when measured at 143 ft/sec inbound velocity.

More generally, the core of the golf balls of the present invention is a unitary core with little or no difference between the hardness of the core measured at its center and the hardness as measured at its outer surface ie no such appreciable core hardness gradient.

However, the core of the golf balls of the present invention may also comprise a center and one or more core layers disposed around the center. These core layers comprise the same rubber as used in the center portion. The various core layers (including the center) may each exhibit a different hardness. The difference between the center hardness and that of the next adjacent layer, as well as the difference in hardness between the various core layers is greater than 2, preferably greater than 5, most preferably greater than 10 units of Shore D.

In one preferred embodiment, the hardness of the center and each sequential layer increases progressively outwards from the center to outer core layer.

In another preferred embodiment, the hardness of the center and each sequential layer decreases progressively inwards from the outer core layer to the center.

Referring to the drawing in FIG. 4, there is illustrated a transverse cross section of a 3 piece golf ball 50 comprising a core 52, an intermediate layer 54 and an outer cover layer 56. Golf ball 50 also typically includes plural dimples 58 formed in the outer cover layer 56 and arranged in various desired patterns (dimples 58 are not to scale, and FIG. 4 does not illustrate the presently disclosed dimple pattern).

More specifically, the intermediate layer of the three piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The intermediate layer of the three piece golf balls of the present invention also has a hardness of from about 25 to about 80, more preferably of from about 30 to about 70, even more preferably of from about 40 to about 60 Shore D.

The outer cover layer of the three piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The outer cover layer of the three piece golf balls of the present invention also has a hardness of from about 25 to about 80, more preferably from about 30 to about 70, even more preferably from about 40 to about 60 Shore D.

The core of the three piece golf balls of the present invention has a diameter of from about 0.5 to about 1.62, preferably from about 0.7 to about 1.60, more preferably from about 1 to about 1.58 inches.

The core of the three piece golf balls of the present invention has a PGA compression of from about 10 to about 100, preferably from about 35 to about 90, more preferably from about 40 to about 80.

The three-piece golf balls of the present invention has a PGA ball compression greater than about 30, preferably greater than 40, more preferably greater than about 50, most preferably greater than about 60.

Figure 5:
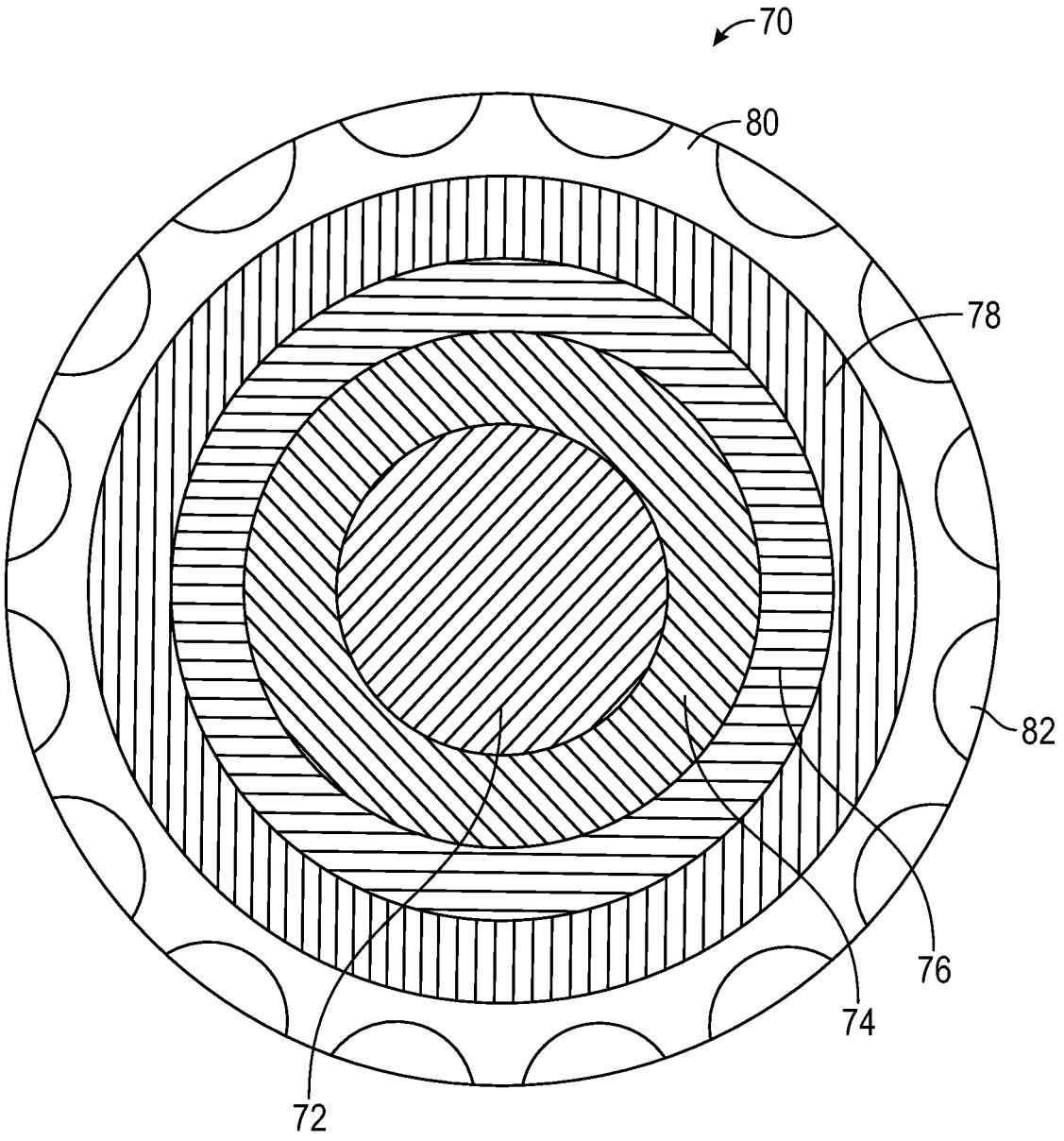
FIG. 5 illustrates a transverse cross section of a 5 piece golf ball 70 comprising a core 72, an inner intermediate layer 74, a center intermediate layer 76, an outer intermediate layer 78 and an outer cover layer 80. Golf ball 70 also typically includes plural dimples 82 formed in the outer cover layer 80 (dimples 82 are not to scale, and FIG. 5 does not illustrate the presently disclosed dimple pattern).

Referring to the drawing in FIG. 5 there is illustrated a transverse cross section of a 5 piece golf ball 70 comprising a core 72, an inner intermediate layer 74, a center intermediate layer 76, an outer intermediate layer 78 and an outer cover layer 80. Golf ball 70 also typically includes plural dimples 82 formed in the outer cover layer 80 and arranged in various desired patterns (dimples 82 are not to scale, and FIG. 5 does not illustrate the presently disclosed dimple pattern).

More specifically, the inner intermediate layer of the five piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The inner intermediate layer of the five piece golf balls of the present invention has a hardness of from about 25 to about 80, more preferably from about 30 to about 70, even more preferably from about 35 to about 60 Shore D.

The center intermediate layer of the five piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The center intermediate layer of the five piece golf balls of the present invention also has a hardness of from about 25 to about 80, more preferably from about 30 to about 70, even more preferably from about 40 to about 60 Shore D.

The outer intermediate layer of the five piece golf balls of the present invention has a thickness of from about 0.01 to about 0.20 inch, preferably from about 0.02 to about 0.15 inch, more preferably from about 0.03 to about 0.10 inch and most preferably from about 0.03 to about 0.07 inches.

The outer intermediate layer of the five piece golf balls of the present invention also has a hardness of from about 25 to about 85, more preferably from about 30 to about 80, even more preferably from about 40 to about 75 Shore D.

The outer cover layer of the five piece golf balls of the present invention has a thickness of from about 0.01 to about 0.20 inch, preferably from about 0.02 to about 0.15 inch, more preferably from about 0.015 to about 0.10 inch and most preferably from about 0.02 to about 0.07 inches.

The outer cover layer of the five piece golf balls of the present invention also has a hardness of from about 25 to about 80, more preferably from about 30 to about 70, even more preferably from about 40 to about 60 Shore D.

The core of the five piece golf balls of the present invention has a diameter of from about 0.5 to about 1.62, preferably from about 0.7 to about 1.60, more preferably from about 1 to about 1.58 inches.

The core of the five piece golf balls of the present invention has a PGA compression of from about 10 to about 100, preferably from about 20 to about 90, more preferably from about 30 to about 80.

The five-piece golf balls of the present invention have a PGA ball compression greater than about 30, preferably greater than 40, more preferably greater than about 50, most preferably greater than about 65.

The total number of reduced equivalent depth dimples (Ni) employed in the dimple pattern used on the golf balls of the present invention comprise of from about 250 to about 500, preferably of from about 275 to about 475, and even more preferably of from about 300 to about 450 reduced equivalent depth dimples. Preferably the reduced equivalent depth dimples comprise dual radius dimples.

The total volume of the reduced equivalent depth dimples (TDV) employed on the golf balls of the present invention is of from about 380 to 425 $mm^3$, preferably of from about 385 to 415 $mm^3$, more preferably of from about 380 to 405 $mm^3$.

The total percentage surface area coverage (COV) of the reduced equivalent depth dimples placed on the surface of the golf balls of the present invention is greater than about 65%, more preferably greater than about 70%, and even more preferably greater than about 75%.

The volume ratios, Vr, of the individual reduced equivalent depth dual radius dimples or the average volume ratio (AvVr) of the reduced equivalent depth dual radius dimples used in the present invention should each be of from about 0.5 to less than about 1, preferably of from about 0.525. to about 0.75, even more preferably of from about 0.55 to about 0.70.

For the reduced equivalent depth dual radius dimples used in the present invention the relative ratio of the diameters, d1/d2 of the dimples, or a, is greater than 0 and less than about 1, preferably is greater than or equal to 0.35 and less than or equal to 0.95 and more preferably is greater than or equal to 0.40 and less than or equal to 0.70.

For the golf balls of the present invention, the ratios of the average volumes of the reduced equivalent depth dual radius dimples in each region, $\overline{V}ex/\overline{V}ei$, $\overline{V}sx/\overline{V}si$ and $\overline{V}px/\overline{V}pi$ are each all greater than or equal to 0.60 and less than or equal to 1.25, preferably each all greater than or equal to 0.65 and less than or equal to 1.20, and even more preferably each all greater than or equal to 0.7 and less than or equal to 1.15.

For the golf balls of the present invention, the depth of the dimples are of from about 0.060 to about 0.200 mm, preferably of from about 0.065 to about 0.180 mm, more preferably of from about 0.070 to about 0.160 mm.

For the golf balls of the present invention, the average depth of the dimples in each region, namely hex, hsx, hpx and hei, hsi and hpi are each of from about 0.060 to about 0.200 mm, preferably of from about 0.065 to about 0.180 mm, more preferably of from about 0.070 to about 0.160 mm.

For the golf balls of the present invention, the depth of the reduced equivalent depth dual radius dimples in the EX region and closest to the parting line of the golf ball are constrained to be greater than about 0.145 mm, preferably greater than about 0.150 mm, even more preferably greater than about 0.155 mm.

For the golf balls of the present invention, the depth ratios of the reduced equivalent depth dual radius dimples hex/hei, hsx/hsi and hpx/hpi are each all greater than or equal to 0.75 and less than or equal to 1.20, preferably each all greater than or equal to 0.78 and less than or equal to 1.15, and even more preferably each all greater than or equal to 0.80 and less than or equal to 1.10.

This magnitude of the variation in the ratios of hex/hei, hsx/hsi and hpx/hpi measured when the ball is rotated from 0 to 360 degrees about either its polar or equatorial axis, are expressed as the percentages % Δe, % Δs and % Δp respectively.

For the golf balls of the present invention, % Δe, % Δs and % Δp are each preferably greater than 0 but less than about 7%, more preferably each greater than about 0.5% but less than about 6.5%, and even more preferably each greater than about 1% but less than about 6%.

EXAMPLES

The following examples are provided to illustrate certain features of working embodiments of the disclosed invention. A person of ordinary skill in the art will appreciate that the invention is not limited to those features exemplified by these working embodiments.

Shore D hardness can be measured in accordance with ASTM D2240. Hardness of a layer can be measured on the ball, perpendicular to a land area between the dimples (referred to as "on-the-ball" hardness). The Shore D hardness of a material prior to fabrication into a ball layer can also be measured (referred to as "material" hardness). Unless otherwise specified the Shore D measurements quoted for the layers of the golf balls of the present invention are measured on the ball.

Core or ball diameter may be determined using standard linear calipers or a standard size gauge.

Compression may be measured by applying a spring-loaded force to the sphere to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inch, the compression is rated at 100; if the spring compresses 0.1 inch, the compression value is rated as 0. Thus, more compressible, softer materials will have lower Atti gauge values than harder, less compressible materials. The value is taken shortly after applying the force and within at least 5 secs if possible. Compression measured with this instrument is also referred to as PGA compression.

The approximate relationship that exists between Atti or PGA compression and Riehle compression can be expressed as: (Atti or PGA compression)=(160-Riehle Compression). Thus, a Riehle compression of 100 would be the same as an Atti compression of 60.

The initial velocity of a golf ball after impact with a golf club is governed by the United States Golf Association ("USGA"). The USGA requires that a regulation golf ball can have an initial velocity of no more than 250 feet per second. The USGA initial velocity limit is related to the ultimate distance that a ball may travel (317 yards) and is also related to the coefficient of restitution ("COR"). The coefficient of restitution is the ratio of the relative velocity between two objects after direct impact to the relative velocity before impact. As a result, the COR can vary from 0 to 1, with 1 being equivalent to a completely elastic collision and 0 being equivalent to a completely inelastic collision. Since a ball's COR directly influences the ball's initial velocity after club collision and travel distance, golf ball manufacturers are interested in this characteristic for designing and testing golf balls.

The ball performance was determined using a Robot Driver Test, which utilized a commercial swing robot in conjunction with a radar measuring system. The test consists of launching the ball using a robotic arm to which was attached a titanium driver at a fixed tee location, club lie angle, swing speed and power profile. A radar system was used to determine the speed, launch angle, backspin, and carry distance of the ball. The data was then processed for multiple shots on different days at an outdoor test facility.

A commercially available TaylorMade Tour Preferred X golf ball was used as a control ball in the setup for the purpose of test validity. A second control ball having the same dimple pattern as the Tour Preferred X was manufactured at the same time and with the same materials and ball construction as the experimental balls in order to remove any variability due to manufacturing conditions such that any measured gain or loss was solely due to the effect of the dimple pattern on the aerodynamics of the experimental balls.

Comparative Example 1

A five piece golf ball was used having a ball construction consisting of a unitary polybutadiene core, core, three intermediate layers made from ionomer formulations and a polyurethane outer cover layer which was cast molded around the combined core and intermediate layers.

A total of 322 single radius spherical dimples were molded on the golf ball surface as shown in Table 1 and where the minimum pattern is mirrored right and copied every 72 degrees. The lower hemisphere is a copy of upper rotated 30 deg about south pole (using right-hand rule).

Example 1

On a golf ball having the same ball construction as Comparative Example 1, a total of 322 reduced equivalent depth dual radius dimples were molded on the golf ball surface as shown in Table 1 and where the minimum pattern is mirrored right and copied every 72 degrees. The lower hemisphere is a copy of upper rotated 30 deg about south pole (using right-hand rule). The dimples are modified as described by substituting reduced equivalent depth dual radius dimples having a dimple diameter relative ratio, a, of 0.5 and with the average volume and average depth and average volume and depth ratio distributions summarized in Table 1.

Example 2

On a golf ball having the same ball construction as Comparative Example 1, a total of 322 reduced equivalent depth dual radius dimples were molded on the golf ball surface as shown in Table 1 and where the minimum pattern is mirrored right and copied every 72 degrees. The lower hemisphere is a copy of upper rotated 30 deg about south pole (using right-hand rule). The dimples are modified as described by substituting reduced equivalent depth dual radius dimples having a dimple diameter relative ratio, a, of 0.5 and with the average volume and average depth and average volume and depth ratio distributions summarized in Table 1.

Example 3

On a golf ball having the same ball construction as Comparative Example 1, a total of 322 reduced equivalent depth dual radius dimples were molded on the golf ball surface as shown in Table 1 where the minimum pattern is mirrored right and copied every 72 degrees. The lower hemisphere is a copy of upper rotated 30 deg about south pole (using right-hand rule). The dimples are modified as described by substituting reduced equivalent depth dual radius dimples having a dimple diameter relative ratio, a, of 0.5 and with the average volume and average depth and average volume and depth ratio distributions summarized in Table 1.

Also, for the golf ball of Example 3 further changes were made in the ratios of hex/hei, hsx/hsi and hpx/hpi such that when the golf ball of Example 3 is initially placed in the cross seam orientation and rotated about its polar axis by a value of 0 as it rotates 0 to 360°. The difference between their minimum and maximum values expressed as a percentage of the mean value (% De, % Ds and % Dp respectively) are shown in FIG. 6 and summarized in Table 1.

Analysis of the data in Table 1 shows that for Comp Ex 1 and Ex 1, 2 and 3 the total number of dimples was kept the same (322) as were their opening diameters which resulted in the same surface area coverage (85%).

Now comparing Comparative Example 1 with Example 1, the 322 spherical single radius dimples were replaced by 322 reduced equivalent depth dual radius dimples having the same outer dimple diameter and a relative ratio, a, of 0.5. In addition, the volume ratio of each dimple was changed from 0.5 in Comparative Example 1 to 0.625 for Example 1. This resulted in a shallowing of the dimples in each region as shown by the reduction of the average depth h in each region. In addition, the average volume $\bar{V}$ of the dimples in each region was decreased sufficient to lower the total dimple volume from 420 $mm^3$ in Comparative Example 1 to 392 $mm^3$ in Example 1 while maintain the average dimple volume ratios at their same values.

These changes in the dimples resulted in the observed increase distance of 6.7 yards for Example 1 relative to Comparative Example 1 when measured at 175 mph ball speed, a 10.8 degree launch angle and approx. 2000 rpm spin rate (which conditions correspond to impact of a shot hit with a driver). This observed relative distance dropped to 1.0 yards when the test conditions were changed to 138 mph ball speed, a 13 degree launch angle and approx. 5500 rpm spin rate (which conditions correspond to the impact of a shot hit with a 6 or 7 iron).

Now comparing Example 1 with Example 2, the only change in the dimples was adjusting the Vr ratio of each of the 322 reduced equivalent depth dual radius dimples from 0.625 for Example 1 to 0.685 for Example 2 (which changes were also reflected by the AvVr values as each of the dimples was set to the same Vr ratio). This resulted in a reduction in the average depth of the dimples in all six regions of the golf balls for Example 2 relative to Example 1 as shown by the reduction in the values for hex, hsx, hpx, hei, hsi and hpi.

The fact that this change was made proportionately for each dimple meant that the shallowing of the dimples was accomplished without changing the average depth ratios for Example 2 relative to Example 1. However, the use of reduced equivalent depth dual radius dimples allowed for the decoupling of dimple depth and volume. The ability to independently change dimple depth and volume allows for the use of shallower dimples in Example 2 relative to Example 1 by varying the dimples Vr and thus lowering the average dimple depth in each region, while keeping constant a) the average total volume $\bar{V}$ of the dimples in each region as well as b) the average total volume ratios in each region ($\bar{V}ex/\bar{V}ei$, $\bar{V}sx/\bar{V}si$ and $\bar{V}px/\bar{V}pi$) and c) the overall total dimple volumes, TDV, for Examples 1 and 2 the same at 392 $mm^3$.

The shallowing of the dimples by increasing Vr while keeping all the other dimple parameters constant resulted in an unexpected observed bifurcation in the distances travelled by each ball as a function of impact conditions. Thus, a distance decrease of −8.75 yds for Example 2 compared to Example 1 (when measured relative to Comparative Example 1) was observed when tested at 175 mph ball speed, a 10.8 degree launch angle and approx. 2000 rpm spin rate (which conditions correspond to impact of a shot hit with a driver).

This observed relative distance decrease changed to an increase of 0.8 yards for Example 2 compared to Example 1 (each relative to Comparative Example 1) observed when the test conditions were changed to 138 mph ball speed, a 13 degree launch angle and approx. 5500 rpm spin rate (which conditions correspond to the impact of a shot hit with a 6 or 7 iron).

Now, comparing Example 1 with Example 3, selective changes were made to the dimple depths in certain regions changes but not proportionately by changing the Vr for all the dimples and thus this resulted in the average depth ratios hex/hei, hsx/hsi and hpx/hpi for Example 3 to be different from those of Example 1 and Example 2 as was the final AvVr which was 0.600. Again the use of reduced equivalent depth dual radius dimples allowed for the decoupling of dimple depth and volume allowed the average total volume $\overline{V}$ of the dimples in each region to be kept constant as well as keeping the average total volume ratios in each region ($\overline{V}$ex/$\overline{V}$ei, $\overline{V}$sx/$\overline{V}$si and $\overline{V}$px/$\overline{V}$pi) constant and keeping the overall total dimple volume, TDV, the same as for Examples 1 and 2 at 392 $mm^3$.

These selective changes to the dimple depths in each region such that the dimple depth ratios hex/hei, hsx/hsi and hpx/hpi tightened as the average difference between their minimum and maximum values as the ball was rotated about its polar axis by a value of 0 as it rotates 0 to 3600 as shown by the lowering of the values for % Δe, % Δs and % Δp. These changes resulted in the ball of Example 3 exhibiting a much improved balance of distance and distance dispersion. Thus, an increased average carry distance of 3 yds was measured relative to Comparative Example 1 when tested at 175 mph ball speed, a 10.8 degree launch angle and approx. 2000 rpm spin rate (which conditions correspond to impact of a shot hit with a driver).

TABLE 1

| | Comp Ex 1 | Ex 1 | Ex 2 | Ex 3 |
|---|---|---|---|---|
| Total No of Dimples (N) | 322 | 322 | 322 | 322 |
| Dimple Type | Single Radius | Dual Radius | Dual Radius | Dual Radius |
| Total No of Dimples in Ex zone (Nex) | 60 | 60 | 60 | 60 |
| Total No of Dimples in Sx zone (Nsx) | 85 | 85 | 85 | 85 |
| Total No of Dimples in Px zone (Npx) | 16 | 16 | 16 | 16 |
| Total No of Dimples in Ei zone (Nei) | 48 | 48 | 48 | 48 |
| Total No of Dimples in Si zone (Nsi) | 69 | 69 | 69 | 69 |
| Total No of Dimples in Pi zone (Npi) | 47 | 47 | 47 | 47 |
| Av Volume of dimples in Ex zone $mm^3$ ($\overline{V}$ ex) | 0.95 | 0.87 | 0.87 | 0.87 |
| Av Volume of dimples in Sx zone $mm^3$ ($\overline{V}$ sx) | 1.40 | 1.29 | 1.29 | 1.29 |
| Av Volume of dimples in Px zone $mm^3$ ($\overline{V}$ px) | 1.31 | 1.20 | 1.20 | 1.20 |
| Av Volume of dimples in Ei zone $mm^3$ ($\overline{V}$ ei) | 1.36 | 1.25 | 1.25 | 1.25 |
| Av Volume of dimples in Si zone $mm^3$ ($\overline{V}$ si) | 1.32 | 1.21 | 1.21 | 1.21 |
| Av Volume of dimples in Pi zone $mm^3$ ($\overline{V}$ pi) | 1.31 | 1.21 | 1.21 | 1.21 |
| Ratio $\overline{V}$ex/$\overline{V}$ei | 0.70 | 0.70 | 0.70 | 0.70 |
| Ratio $\overline{V}$sx/$\overline{V}$si | 1.07 | 1.07 | 1.07 | 1.07 |
| Ratio $\overline{V}$px/$\overline{V}$pi | 0.99 | 0.99 | 0.99 | 0.99 |
| Average Depth of Dimples in Ex zone mm (hex) | 0.1786 | 0.1316 | 0.1200 | 0.1406 |
| Average Depth of Dimples in Sx zone mm (hsx) | 0.1720 | 0.1268 | 0.1156 | 0.1268 |
| Average Depth of Dimples in Px zone mm (hpx) | 0.1379 | 0.1016 | 0.0926 | 0.1153 |
| Average Depth of Dimples in Ei zone mm (hei) | 0.1728 | 0.1274 | 0.1161 | 0.1326 |
| Average Depth of Dimples in Si zone mm (hsi) | 0.1709 | 0.1260 | 0.1148 | 0.1303 |
| Average Depth of Dimples in Pi zone mm(hpi) | 0.1704 | 0.1256 | 0.1145 | 0.1308 |
| Ratio hex/hei | 1.034 | 1.034 | 1.034 | 1.060 |
| Ratio hsx/hsi | 1.006 | 1.006 | 1.006 | 0.973 |
| Ratio hpx/hpi | 0.809 | 0.809 | 0.809 | 0.881 |
| % Δe | 5.8 | 5.8 | 5.8 | 5.3 |
| % Δs | 3.2 | 3.2 | 3.2 | 2.8 |
| % Δp | 4.4 | 4.4 | 4.4 | 3.9 |
| % Dimple Surface Area Coverage (COV) | 85% | 85% | 85% | 85% |
| Av Dimple Volume Ratio (AvVR) | 0.500 | 0.625 | 0.685 | 0.600 |
| Total Dimple Volume $mm^3$ (TDV) | 420 | 392 | 392 | 392 |
| Av. Relative Distance (yds) 175 mph, 10.8° launch angle, 1800-2100 rpm spin rate | Set to 0 | 6.7 | −2.25 | 3.0 |
| Av. Relative Distance (yds) 138 mph, 13° launch angle, 5500 rpm spin rate | Set to 0 | 1.0 | 1.8 | 1.0 |
| In-seam/cross-seam carry distance difference (yds) 175 mph, 10° launch angle, 2525 rpm spin rate | 0.8 | 6.59 | 1.0 | 1.3 |

Also, an increased average carry distance increase of 1.0 yards was measured relative to Comparative Example 1 when the test conditions were changed to 138 mph ball speed, a 13 degree launch angle and approx. 5500 rpm spin rate (which conditions correspond to the impact of a shot hit with a 6 or 7 iron). In addition, the ball of Example 3 also exhibited greatly improved narrower average dispersion (in terms of inseam distance as compared cross seam distance) as compared to the ball of Example 1, going from 6.59 yds average dispersion for Example 1 to 1.3 yds for Example 3.

In view of the many possible embodiments to which the principles of the disclosed invention may be applied, it should be recognized that the illustrated embodiments are only preferred examples of the invention and should not be taken as limiting the scope of the invention.

The invention claimed is:

1. A golf ball having dual radius dimples on its surface having a plurality of depths and which when orientated in the cross seam direction has;

an equator at latitude 0° and poles at latitude 90° and longitude 0°, a region Ex defined by latitudes 0° to 25° having 60 dual radius dimples, each of the 60 dual radius dimples having a center located within the region Ex;

a shoulder region Sx defined by latitudes from more than 25° to less than 65° having 85 dual radius dimples, each of the 85 dual radius dimples having a center located within the region Sx;

a pole region Px defined by latitudes 65° to 90° having 16 dual radius dimples, each of the 16 dual radius dimples having a center located within the region Px;

wherein the dual radius dimples have:

i) an average total depth from 0.06 to 0.20 mm;

ii) a relative ratio, a, of 0.5, where a=d1/d2, wherein d2 is the diameter of the dimple at an open end; and d1 is a first diameter measured at a portion of the of the dimple below the open end;

iii) a volume ratio (Vr), from 0.55 to 0.70, where $Vr=Vi/(\pi \cdot hi \cdot d2^2/4)$, wherein $V_i$ is the total volume of the dual radius dimple, and $h_i$ is the total depth of that dual radius dimple, and the dual radius dimples have an average volume from 0.85 $mm^3$ to 1.3 $mm^3$.

2. The golf ball of claim 1, further comprising Ei defined by longitudes 0 to 25°,and a region Si defined by longitudes from more than 25° to less than 65° and a region Pi defined by longitudes 65° to 90°, wherein hei is the average dimple depth in the region Ei, hsi is the average dimple depth in the region Si and hpi is the average dimple depth in the region Pi, wherein there are 60 dimples in the Ex region, 85 dimples in the Sx region and 16 dimples in the Px region; and wherein the average depth of the dimples in the hex, hsx, hpx, hei, hsi and hpi is 0.1316, 0.1268, 0.1016, 0.1274, 0.1260, and 0.1256 mm respectively.

3. The golf ball of claim 2, wherein the ratios hex/hei, hsx/hsi and hpx/hpi are 1.034, 1.006, and 0.809, respectively.

4. The golf ball of claim 3, wherein the total percentage surface area coverage (COV) of the dimples placed on the surface of the golf ball is at least 85%.

5. The golf ball of claim 4, having: an average dimple volume in the region Ex (Vex) of 0.87 $mm^3$, an average dimple volume in the region Sx (Vsx) of 1.29 $mm^3$, an average dimple volume in the region Px (Vpx) of 1.20 $mm^3$, an average dimple volume in the region Ei (Vei) of 1.25 $mm^3$, an average dimple volume in the region Si (Vsi) of 1.21 $mm^3$, and an average dimple volume in the region Pi (Vpi) of 1.21 $mm^3$.

6. The golf ball of claim 5, wherein the ratios Vex/Vei, Vsx/Vsi, and Vpx/Vpi are 0.70, 1.07, and 0.99, respectively.

7. The golf ball of claim 6, having an average dimple volume ratio (AvVR) of 0.625.

8. The golf ball of claim 7, having a total dimple volume of 392 $mm^3$.

9. A golf ball having dual radius dimples on its surface having a plurality of depths and which when orientated in the cross seam direction has;

an equator at latitude 0°, and poles at latitude 90° and longitude 0°, a region Ex defined by latitudes 0° to 25° having 60 dual radius dimples, each of the 60 dual radius dimples having a center located within the region Ex;

a shoulder region Sx defined by latitudes from more than 25° to less than 65° having 85 dual radius dimples, each of the 85 dual radius dimples having a center located within the region Sx;

a pole region Px defined by latitudes 65° to 90° having 16 dual radius dimples, each of the 16 dual radius dimples having a center located within the region Px;

wherein hex is the average dimple depth in the region Ex, hsx is the average dimple depth in the region Sx, hpx is the average dimple depth in the region Px;

wherein each dual radius dimple has:

i) an average total depth of the dual radius dimples from 0.06 to 0.20 mm;

ii) a relative ratio, a, of 0.5, where a=d1/d2, wherein d2 is the diameter of the dimple at an open end; and d1 is a first diameter measured at a portion of the of the dimple below the open end;

iii) a volume ratio, Vr, from 0.55 to 0.70, where $V_r=V_i/(\pi \cdot hi \cdot d2^2/4)$, wherein $V_i$ is the total volume of the dual radius dimple and h; is the total depth of the dual radius dimple, and the dual radius dimples have an average volume from 0.85 $mm^3$ to 1.3 $mm^3$; and wherein the golf ball comprises;

a core comprising a polybutadiene;

one or more intermediate layers selected from the group consisting of unimodal ionomers, bimodal ionomers, modified unimodal ionomers, modified bimodal ionomers and any and all combinations thereof; and an outer cover layer selected from the group consisting of thermoset polyurethanes, thermoset polyureas, thermoplastic polyurethanes, thermoplastic polyureas, unimodal ionomers, bimodal ionomers, modified unimodal ionomers, modified bimodal ionomers and any and all combinations thereof.

* * * * *